US011571912B2

(12) United States Patent
Jäger et al.

(10) Patent No.: US 11,571,912 B2
(45) Date of Patent: Feb. 7, 2023

(54) TILTABLE MOUNTING DEVICE, PRINTING SYSTEM AND METHOD FOR PRINTING ON CYLINDRICAL OBJECTS

(71) Applicant: Vinventions USA, LLC, Zebulon, NC (US)

(72) Inventors: Jens Peter Jäger, Lambrecht (DE); Karl Helmut Thate, Neustadt an der Weinstrasse (DE)

(73) Assignee: VINVENTIONS USA, LLC, Zebulon, NC (US)

( * ) Notice: Subject to any disclaimer, the term of this patent is extended or adjusted under 35 U.S.C. 154(b) by 130 days.

(21) Appl. No.: 16/976,964

(22) PCT Filed: Mar. 18, 2019

(86) PCT No.: PCT/US2019/022731
§ 371 (c)(1),
(2) Date: Aug. 31, 2020

(87) PCT Pub. No.: WO2019/178591
PCT Pub. Date: Sep. 19, 2019

(65) Prior Publication Data

US 2021/0001646 A1 Jan. 7, 2021

(30) Foreign Application Priority Data

Mar. 16, 2018 (WO) ..... PCT/US2018/022948
Aug. 29, 2018 (WO) ..... PCT/US2018/048519
Oct. 4, 2018 (WO) ..... PCT/US2018/054374

(51) Int. Cl.
*B41J 3/407* (2006.01)

(52) U.S. Cl.
CPC ..... *B41J 3/4073* (2013.01); *B41J 3/40731* (2020.08); *B41J 3/40733* (2020.08)

(58) Field of Classification Search
CPC ... B41J 3/4073; B41J 3/40731; B41J 3/40733
See application file for complete search history.

(56) References Cited

U.S. PATENT DOCUMENTS 6,167,805 B1 1/2001 Williams et al.
6,769,357 B1 8/2004 Finan
(Continued)

FOREIGN PATENT DOCUMENTS

CN 2286467 Y 7/1998
CN 104093793 A 10/2014
(Continued)

OTHER PUBLICATIONS

Examination Report for Australian Patent Application No. 2019236318, dated Jun. 21, 2021, 3 pages.
(Continued)

*Primary Examiner* — David H Banh
(74) *Attorney, Agent, or Firm* — Withrow & Terranova, P.L.L.C.; Vincent K. Gustafson

(57) ABSTRACT

A tiltable mounting device is for mounting cylindrical objects with a top surface and a lateral surface, and for tilting the objects relative to a reference plane. The device has a frame, and one or more mandrels, each configured to mount a cylindrical object. Each mandrel is rotatable about a longitudinal axis, and is tiltable in the frame between first and second positions. The longitudinal axis of each mandrel in the first position is oriented perpendicularly to the longitudinal axis of the respective mandrel in the second position. In the first position, each mandrel is oriented with the top surface of the object in the reference plane, and in the second position, each mandrel is oriented such that the lateral surface of the cylindrical object is tangent to the reference plane.

27 Claims, 17 Drawing Sheets

(56) References Cited

U.S. PATENT DOCUMENTS

| | | | | |
|---|---|---|---|---|
| 2008/0088653 | A1* | 4/2008 | Baker | B41J 11/008 358/1.18 |
| 2009/0145511 | A1 | 6/2009 | Till | |
| 2011/0232514 | A1 | 9/2011 | Putzer et al. | |
| 2014/0134333 | A1 | 5/2014 | Hedges | |
| 2015/0033964 | A1 | 2/2015 | Perego | |
| 2017/0056918 | A1 | 3/2017 | Allen et al. | |

FOREIGN PATENT DOCUMENTS

| | | | |
|---|---|---|---|
| CN | 104203583 | A | 12/2014 |
| CN | 105764692 | A | 7/2016 |
| CN | 107813616 | A | 3/2018 |
| DE | 202004019382 | U1 | 2/2005 |
| DE | 102013214934 | A1 | 2/2015 |
| DE | 102015224975 | A1 | 6/2017 |
| EP | 1782951 | A1 | 5/2007 |
| EP | 2730418 | A1 | 5/2014 |
| EP | 2832548 | A1 | 2/2015 |
| EP | 2993053 | A1 | 3/2016 |
| GB | 888796 | A | 2/1962 |
| GB | 1014187 | A | 12/1965 |
| JP | 2000006493 | A | 1/2000 |
| JP | 2001180628 | A | 7/2001 |
| JP | 3589499 | B2 | 11/2004 |
| JP | 2013166587 | A | 8/2013 |
| JP | 2017131879 | A | 8/2017 |
| WO | 2008029215 | A2 | 3/2008 |
| WO | 2008048885 | A2 | 4/2008 |
| WO | 2012088053 | A1 | 6/2012 |
| WO | 2015016628 | A1 | 2/2015 |
| WO | 2015177599 | A1 | 11/2015 |
| WO | 2016014958 | A1 | 1/2016 |
| WO | 2017109506 | A2 | 6/2017 |
| WO | 2019177627 | A1 | 9/2019 |
| WO | 2020046291 | A1 | 3/2020 |
| WO | 2020072061 | A1 | 4/2020 |

OTHER PUBLICATIONS

First Office Action for Chinese Patent Application No. 201980019784.3, dated Jun. 25, 2021, 25 pages.

International Search Report and Written Opinion for International Patent Application No. PCT/US2018/022948, dated Nov. 29, 2018, 13 pages.

International Search Report and Written Opinion for International Patent Application No. PCT/US2018/048519, dated Apr. 25, 2019, 12 pages.

International Search Report and Written Opinion for International Patent Application No. PCT/US2018/054374, dated Dec. 3, 2018, 10 pages.

International Search Report and Written Opinion for International Patent Application No. PCT/US2019/022731, dated Jun. 25, 2019, 14 pages.

Second Office Action for Chinese Patent Application No. 201980019784.3, dated Mar. 9, 2022, 26 pages.

Examination Report for European Patent Application No. 19712110.6, dated Sep. 9, 2022, 6 pages.

Second Office Action for Chinese Patent Application No. 201980065821.4, dated Oct. 10, 2022, 17 pages.

* cited by examiner

TILTABLE MOUNTING DEVICE, PRINTING SYSTEM AND METHOD FOR PRINTING ON CYLINDRICAL OBJECTS

CROSS-REFERENCE TO RELATED APPLICATIONS

This application is a 35 U.S.C. § 371 national phase filing of International Application No. PCT/US2019/022731 filed on Mar. 18, 2019, and claims priority to each of International Application No. PCT/US2018/022948, filed Mar. 16, 2018, International Application No. PCT/US2018/048519 filed Aug. 29, 2018, and International Application No. PCT/US2018/054374 filed Oct. 4, 2018, wherein the entire disclosures of the foregoing applications are hereby incorporated by reference herein.

FIELD OF THE INVENTION

The present invention relates to a tiltable mounting device, to a printing system, and to a method for printing on cylindrical objects.

BACKGROUND OF THE INVENTION

As in every other production industry, branding of products is a pivotal strategic and marketing factor for the producers of bottled beverages. When aiming at developing a unique branding for bottled beverages with a largely uniform container design, such as wine bottles with screw caps, the design of the label and the screw cap are essentially the only designable components. For that reason, there is a need for printing facilities that enable printing on labels and screw caps. The geometry of the screw caps poses a particular challenge for a corresponding printing apparatus, since screw caps are cylindrical objects with a planar top surface and a cylindrical lateral surface, both of which have to be printed. Such a printing process requires—by far—more advanced technologies than printing on planar labels, for which conventional paper printing technology may be applied.

An exemplary apparatus for printing on cylindrical objects is disclosed by WO 2015/16628 A1. It comprises a plurality of stationary printheads and a holding device for holding the cylindrical objects in a fixed orientation. The holding device moves the cylindrical objects into the vicinity of the printheads such that the printheads may print on the cylindrical object. The fixed orientation of the cylindrical objects ensures a reproducible orientation of the printheads relative to the cylindrical objects, which allows for simplifying the ink feed system needed to feed the ejectors of the printheads.

The conventional printing apparatus for cylindrical objects mentioned above is designed to print on the lateral surface of the cylindrical objects. However, for cylindrical objects, such as screw caps, it is desirable to allow printing on the top surface of the cylindrical objects as well.

SUMMARY OF THE INVENTION

It is an object of the present invention to provide a printing system that enables printing on both a lateral surface and a top surface of cylindrical objects. Further, it is an object of the present invention to enable printing on the top and lateral surface of cylindrical objects at an elevated throughput with increased reliability and a minimum number of printheads.

The above and further features and advantages of the invention will become more readily apparent from the following detailed description of preferred embodiments of the invention with reference to the accompanying drawings, in which reference signs designate features, and in which:

DETAILED DESCRIPTION OF THE INVENTION

Figure 1:
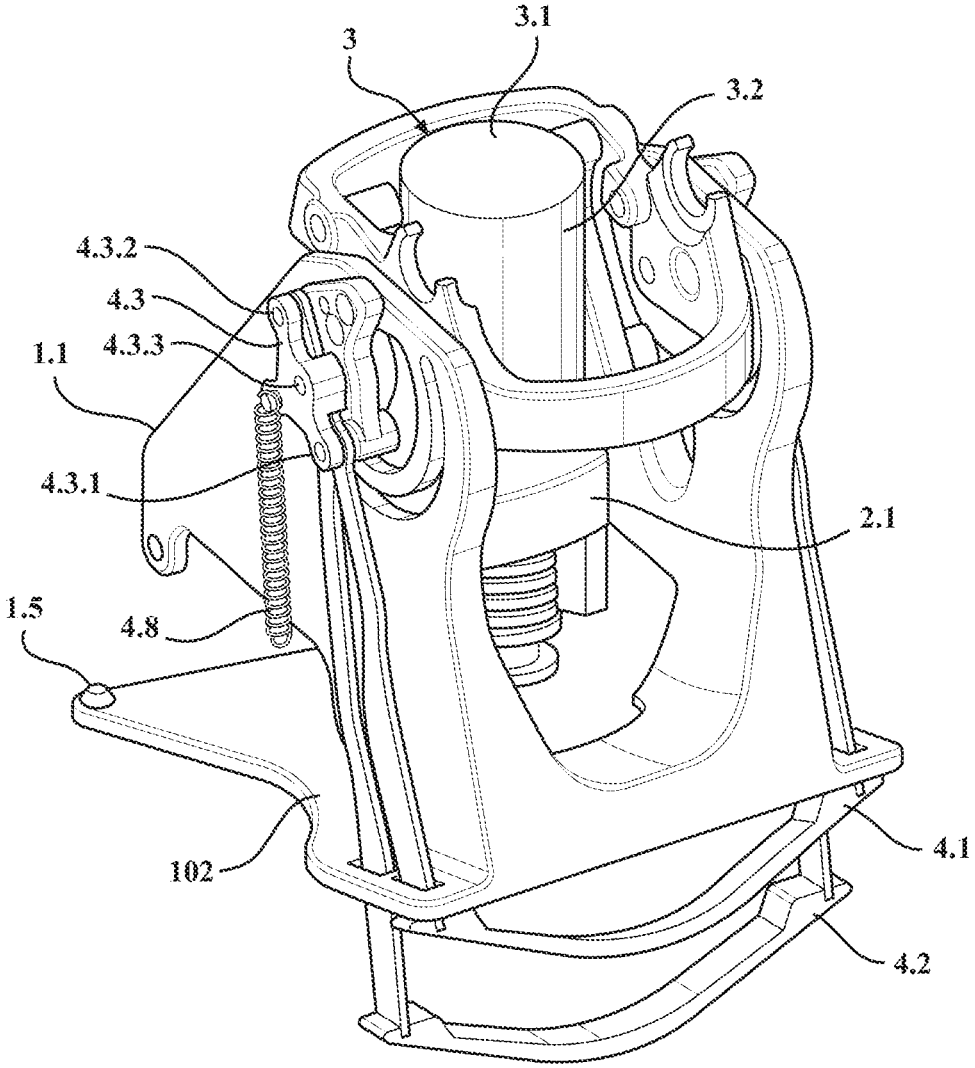
FIG. 1 shows a perspective view of a tiltable mounting device according to a first embodiment of the present invention.

The above object is solved by a tiltable mounting device according to claim 1 and 8, a printing system according to claim 13 and 14, and a method for printing on cylindrical objects according to claim 19 and 20.

Specifically, the present invention provides a tiltable mounting device for mounting cylindrical objects, particularly screw caps, that comprise a lateral surface and a top surface, and for tilting the cylindrical objects relative to a reference plane, comprising:

a frame, one or more mandrels that are each configured to mount a cylindrical object, particularly a screw cap, wherein each mandrel has a longitudinal axis around which it is rotatable, wherein each mandrel is tiltable in the frame between a first position and a second position, wherein the longitudinal axis of each mandrel in the first position is oriented essentially perpendicularly to the longitudinal axis of the mandrel in the second position, wherein, in the first position, each mandrel is oriented such that the top surface of the cylindrical object mountable on the mandrel lies in the reference plane, and in the second position, each mandrel is oriented such that the lateral surface of the cylindrical object mountable on the mandrel is tangent to the reference plane.

With the tiltable mounting device according to the present invention, cylindrical objects mounted on the tiltable mounting device can be tilted from a first position to a second position relative to a reference plane (and back from the second to the first position) and rotated around their longitudinal axis in the respective positions to iteratively print on the surfaces of a larger number of cylindrical objects. Thus, the entire surface of the cylindrical object, i.e. the lateral surface as well as the top surface of the cylindrical object can be brought into contact with the reference plane. If a printhead that is configured to print in the reference plane is provided, the entire outer surface of the cylindrical objects can be printed by using only one printhead. That approach reduces technical complexity and maintenance requirements of a printing system for cylindrical objects. Further, the tilting mechanism allows the entire surface of cylindrical objects mounted on the tiltable mounting device to be brought into contact with a single, spatially fixed printing head for printing without moving the printhead. As a result, the throughput of a printing system comprising the tiltable mounting device can be considerably increased. It is also possible to utilize multiple printheads that are arranged to print within the reference plane.

A cylindrical object in the context of this application is to be understood as an object with a substantially constant cross section along at least a major portion of its spatial extension in one direction, or an object which is at least substantially rotationally symmetric around a longitudinal axis. In order to be mountable on the mandrel of the tiltable mounting device, the cylindrical object is open at one end of the longitudinal axis, whereas the other end of the cylindrical object is covered by a substantially flat top surface. Preferably, the cylindrical objects to be mounted on the mandrel of the tiltable mounting device are screw caps for sealing (glass) bottles.

Within the context of this application, the term "screw cap" is to be understood to also comprise shells, a production precursor of ready to use screw caps. Screw caps comprise roll-on caps, as well as caps with a preformed internal thread.

It should be noted that the position of the mandrel in which the cylindrical object is mountable may already be the first or second position.

According to a preferred embodiment of the present invention, the tiltable mounting device comprises no more than one mandrel. By such a configuration, a simple, compact tiltable mounting device that is easy to maintain is realized.

By another preferred embodiment, the tiltable mounting device comprises two mandrels. By such a configuration, the throughput of a printing system in which the tiltable mounting device is used can be increased, since two mandrels allow cylindrical objects to be printed simultaneously.

It is preferred that the two mandrels are mounted in the frame such that one mandrel is oriented in the first position, while the other mandrel is oriented in the second position at a particular moment in time, and vice versa. That embodiment enables simultaneous printing on cylindrical objects mounted on two mandrels. The cylindrical object mounted on the mandrel in the first position can be printed on the top surface, while the cylindrical object mounted on the mandrel in the second position can be printed on the lateral surface simultaneously. Thereby, the throughput of a printing system comprising the tiltable mounting device is further increased.

It is preferred that the tiltable mounting device comprises a rotation coupling for each mandrel that is configured to be releasably coupled with a rotational force generator to rotate the mandrel around its longitudinal axis. The releasable coupling may be achieved by a force-locking connection, wherein the proximal end of a shaft driven by the rotational force generator device is inserted into a correspondingly shaped socket of the rotation coupling—analogous to a screw driver engaging with a screw head. When the rotation coupling is coupled, the rotational force generated by the rotational force generator can be transmitted to the rotation coupling. The rotation coupling is configured to transmit the rotational force to the mandrel such that it is set into rotation around its longitudinal axis. The rotational force generator may be a rotational motor, a drive motor or a servo actuator with a corresponding output shaft. When the rotational force generator is coupled with the rotation coupling, the rotation of the mandrel around its longitudinal axis is precisely controlled. When the mandrel is tilted, the rotational force generator can preferably be decoupled from the rotation coupling in order to avoid hindrance of the tilting motion, and reconnected when the tilting motion of the mandrel is completed. According to the present invention, a rotational force generator may be directly attached to the mandrel(s).

In a further preferred embodiment, the tiltable mounting device comprises at least one actuating element that is slidably mounted on the frame and configured to effect tilting of the mandrels when actuated. Actuation of the actuating element is achieved by a lateral motion of the actuating element relative to the frame. Such a lateral motion is translated into a tilting motion of the mandrel(s). By such a configuration, tilting of the mandrels can be reliably and simply controlled by a lateral motion of the actuating element.

It is further preferred that the at least one actuating element is hingeably coupled to one or more linkage plates that are configured to translate a translational motion of the at least one actuating element into tilting of the mandrels. Such a configuration provides a mechanically stable and reliable solution for translating the actuation of the at least one actuation element into a tilting motion of the mandrel(s).

The object of the present invention is further solved by a tiltable mounting device for mounting cylindrical objects, particularly screw caps, that comprise a top surface and a lateral surface, and for tilting the cylindrical objects relative to a reference plane, comprising:

a frame, a rotary disc on which a plurality of mandrels that are each configured to mount a cylindrical object, particularly a screw cap, are mounted in parallel in a circular arrangement, wherein each mandrel has a longitudinal axis around which it is rotatable, wherein the rotary disc is tiltable in the frame between a first position and a second position, wherein, in the first position, the rotary disc is oriented such that the longitudinal axes of the mandrels are oriented essentially perpendicularly to the longitudinal axes of the mandrels in the second position, wherein, in the first position, the mandrels are oriented such that the top surfaces of the cylindrical objects mountable on the mandrels lie in the reference plane, and in the second position, the mandrels are oriented such that, when rotating the rotary disc, the lateral surfaces of the cylindrical objects mountable on the mandrels are tangent to the reference plane.

By a tiltable mounting device configured as specified above, a plurality of cylindrical objects can be mounted on one single tiltable mounting device. When the tiltable mounting device is in the first position, the top surfaces of all cylindrical objects lie in a reference plane. By a printhead configured to print in the reference plane, all top surfaces can be printed. Once the tiltable mounting device is tilted to its second position, the lateral surface of each cylindrical object can be successively brought into contact with the reference plane by rotating the rotary disc to a corresponding position. Now, the cylindrical object whose lateral surface is tangent to the reference plane can be rotated around its longitudinal axis in order to print the entire lateral surface thereof. Thus, all cylindrical objects mounted on the tiltable mounting device can be printed with a single, stationary printhead at an increased throughput. The tiltable mounting device of that embodiment comprises at least three mandrels, e.g. 3, 4, 5, 6, 7, or 8 mandrels. The mandrels are mounted on the rotary disc in parallel, i.e., the longitudinal axes of the respective mandrels are oriented in parallel, preferably essentially perpendicular to the surface of the rotary disc on which the mandrels are mounted.

It should be noted that the position of the rotary in which the cylindrical objects are mountable may already be the first or second position.

In a preferred embodiment, the tiltable mounting device comprises seven or eight mandrels. Such a device allows for a significant increase of the throughput without requiring advanced additional constructional efforts. However, the tiltable mounting device may also comprise less than seven or eight or more than seven or eight mandrels.

In a further preferred embodiment, the tiltable mounting device comprise a mandrel rotation coupling that is configured to be releasably coupled with a rotational force generator to rotate the mandrels around their respective longitudinal axis. This allows for an efficient and simple control of the rotational motion of the mandrels. Alternatively, a rotational force generator for the rotation of the mandrels is permanently technically realized in the tiltable mounting device.

The tiltable mounting device preferably further comprises a disc rotation coupling that is configured to be releasably coupled with a rotational force generator to rotate the rotary disc. Thus, control of the rotational motion of the rotary disc may also be exerted in a precise way whilst lowering the weight of the tiltable mounting device. The rotational force generator for the rotation of the rotary disc could also be permanently technically realized in the tiltable mounting device.

It is further preferred that the tiltable mounting device is connectable to an actuating element that is configured to effect tilting of the rotary disc when actuated. Such an embodiment allows to externally control the tilting motion of the rotary disc.

The object of the present invention is further solved by a printing system for cylindrical objects, comprising:

at least one tiltable mounting device, and at least one printhead that is configured to print on surfaces of cylindrical objects in the reference plane.

The advantages of the tiltable mounting device described above are most effectively utilized in a printing system as specified above. The mountable tilting device is configured to tilt cylindrical objects from a first position in which the top surface of the cylindrical object lies in the reference plane, to a second position (and back from the second to the first position) in which the lateral surface of the cylindrical object lies in the reference plane. The printhead is configured to print in the reference plane such that the entire surface of the cylindrical object can be printed without moving the printhead, by tilting and rotating the cylindrical object via the tiltable mounting device only. For the tiltable mounting device with a rotary disc (on which the mandrels are mounted), the printing process also involves rotating the rotary disc in order to bring the cylindrical objects (mounted on the circularly arranged mandrels) into contact with the reference plane.

Preferably, the at least one printhead is configured as an industrial printhead with one or more rows of ink nozzles that are arranged in parallel on the printhead. The at least one printhead is preferably oriented such that the extension direction of the row of ink nozzles is parallel to the longitudinal axis of the mandrels in the second position. Thus, when the mandrels are tilted to the second position such that the lateral surface of a mounted cylindrical object is tangent to the reference plane, the section of the lateral surface of the cylindrical object that is tangent to the reference plane is in direct vicinity of the ink jet row. As a result, printing on that section of the cylindrical object is enabled.

By a preferred embodiment, the at least one printhead is configured to be movable in a direction parallel to the reference plane and perpendicular to the longitudinal axis of the mandrels in the second position. Such a technical solution could be preferable whenever the printhead comprises more than one row of ink nozzles. When printing on the lateral surface of the cylindrical objects, motion of the printhead perpendicular to the longitudinal axis of the mandrels in the second position allows to bring each ink nozzle row into a position that allows printing on the cylindrical object.

It is further preferred that the at least one mounting device is configured to be movable in a direction parallel to the reference plane, and, preferably, perpendicular to a direction along the rows of ink nozzles. In this way, the printhead can remain stationary whilst the tiltable mounting device is tilted into the first position and movel along said direction parallel to the reference plane. Thus, the entire top surface of the cylindrical objects can be printed without moving the printhead.

In a further preferred embodiment, the printing system further comprises a conveying device that is configured to move the at least one tiltable mounting device into the vicinity of the at least one printhead, e.g. 2, 3, 4 or 5 printheads. By such a configuration, a plurality of printheads may be provided in an essentially fixed position. The tiltable mounting device with its mounted cylindrical objects may successively be moved from one printhead to another to enable printing on the cylindrical objects by each printhead successively. Such a configuration is especially advantageous whenever color printing by separate printheads for each color were envisaged.

The object of the invention is further solved by a method for printing on cylindrical objects, particularly screw caps, the method comprising the following steps:

mounting at least one cylindrical object on at least one mandrel of a tiltable mounting device in a printing system as specified above, tilting the at least one mandrel to a first position, printing on the top surface of the at least one cylindrical object, tilting the at least one mandrel to a second position, and rotating the at least one mandrel around the longitudinal axis and printing on the lateral surface of the at least one cylindrical object.

The object of the present invention is also solved by a method for printing on cylindrical objects, particularly screw caps, the method comprising the following steps:

mounting a plurality of cylindrical objects on the mandrels of a tiltable mounting device in a printing system as specified above, tilting the rotary disc to a first position, printing on the top surface of the cylindrical objects, tilting the rotary disc to a second position, and rotating the rotary disc and the plurality of mandrels around their respective longitudinal axis and printing on the lateral surface of the cylindrical objects.

By either method of invention, an efficient and reliable printing process involving a minimum number of printheads at an elevated throughput is realized. The printhead(s) stay(s) essentially stationary during the printing process in a single pass printing process, or maybe moved by suitable technical aids (e.g. voice coils) in a multiple pass printing process, while the cylindrical objects are tilted to positions that allow printing on their entire surface. It should be noted that the order of the printing steps may also be reversed, i.e., to initially tilt the mandrels and/or the rotary disc to a second position and print on the lateral surface of the cylindrical objects first, and to tilt thereafter the mandrels and/or the rotary disc to the first position and print on the top surface of the cylindrical objects afterwards.

It should be noted that the position of the mandrel or rotary disc in which the cylindrical object or the cylindrical objects is/are mountable may already be the first position. In this case, the step of tilting the mandrel or rotary disc into the first position may be omitted.

It is further preferable that the step of printing on the top surface of the at least one cylindrical object comprises rotating the at least one mandrel. A rotation of the cylindrical object around its longitudinal axis enables printing on the entire top surface without moving the printhead.

It is further preferable that the step of printing on the top surface of the at least one cylindrical object comprises simultaneously rotating the rotary disc and/or the mandrels. Thereby, positioning of the top surface of the cylindrical objects in a position that allows printing with a stationary printhead can be achieved more efficiently.

It is further preferred that the step of printing on the top surface of the at least one cylindrical object comprises moving the tiltable mounting device parallel to the reference plane. With this method, different sections of the top surface can be brought into a position that is accessible by the printhead without rotating the mandrels, so that the entire top surface may be printed.

Also, in the first position, the top surfaces of the cylindrical objects may be printed by moving the printhead only, even without rotating the mandrels and/or the rotary disc. Accordingly, either of rotating the mandrels and/or the rotary disc, moving the tiltable mounting device parallel to the reference plane and of moving the printhead or a combination thereof may be envisaged.

It is further preferred that printing of the cylindrical objects is performed by a first printhead, the tiltable mounting device is moved to at least one further printhead and the cylindrical objects are printed by the at least one further printhead. The alternating procedure of printing with a printhead and moving the tiltable mounting device to a further printhead may be iteratively repeated. Upon moving to a printhead, the printing procedure comprises the method steps described above, i.e., tilting the tiltable mounting device to a first position, printing on the top surface of the cylindrical objects whilst rotating the mandrels and/or rotary disc and/or moving the printhead, and tilting the tiltable mounting device to a second position and printing on the lateral surface of the cylindrical objects whilst rotating the mandrels and/or rotary disc and/or moving the printhead. By that method, color printing with a plurality of printheads for individual colors can be efficiently combined with the specific advantages achieved by the present invention.

According to a further preferred embodiment, the mandrels comprise an expansion region being expandable in a radial direction with respect to a longitudinal axis of the mandrel. Preferably, the expansion region is arranged at a lateral wall of an expansion sleeve of the mandrel comprising the form of a hollow cylinder. By means of the expansion region, a friction fit between an inner surface of a lateral wall of the cylindrical object and an outer surface of the expansion region may be obtained. In this regard, the expansion region preferably is configured to be moved into an expanded position and a not-expanded position, wherein in the expanded position, the expansion region comprises a greater diameter than in the not-expanded position.

The tiltable mounting device preferably comprises a heating device for heating the cylindrical objects mounted on the mandrels. Preferably, the heating unit is arranged for heating the cylindrical object from an outer side of the cylindrical object and/or the heating unit is arranged for heating the cylindrical object from an inner side of the cylindrical object.

FIG. 1 is a perspective view of a tiltable mounting device 10 according to a first embodiment of the present invention. The tiltable mounting device 10 comprises a frame 1 composed of frame elements 1.1, 1.2 that are connected to form a rigid carrying structure. Inside frame 1, mandrel 2 is movably mounted. Mandrel 2 is of essentially cylindrical shape and configured as an expanding mandrel, such that a hollow cylindrical object with a diameter larger than that of the mandrel can be put over the mandrel and be held and retained on the mandrel by frictional contact with the expanding mandrel on the inner surface of the cylindrical object.

The cylindrical objects to be mounted on mandrel 2 of FIG. 1 are hollow cylindrical objects with a lateral surface 3.2 and one top surface 3.1, and with an inner surface bounding a cavity. FIG. 1 shows a cylindrical object 3 mounted on mandrel 2 as described above, with the top surface 3.1 being exposed. The bottom of cylindrical object 3 is open to allow for sliding insertion of cylindrical object 3 onto mandrel 2. Cylindrical object 3 has a longitudinal axis that coincides with the longitudinal axis of mandrel 2, once cylindrical object 3 has been mounted on mandrel 2.

Mandrel 2 is mounted movably in the frame 1, so as to be tiltable from a first position, which is an end position of the tilting motion, to a second position, which is another end position of the tilting motion. The tilting motion can be triggered by application of forces exerted by a component (not shown), e.g. a motor, which is typically separate from the tiltable mounting device 10. That further component serves as actuating force for actuating elements provided on the tiltable mounting device 10. As actuating elements, a first bracket 4.1 and a second bracket 4.2 are slidably mounted on frame 1 of the tiltable mounting device 10. Both brackets 4.1 and 4.2 essentially form a U-shaped structure. Parallel arms of brackets 4.1, 4.2 are guided through holes in the frame 1 and are thus supported on frame 1.

As can be seen from FIG. 1, brackets 4.1, 4.2 are hingeably connected to a linkage plate 4.3 via connection sections 4.3.1 and 4.3.2. A further linkage plate with a configuration corresponding to that of the linkage plate 4.3 is positioned on the outwardly facing side of the tiltable mounting device 10 in FIG. 1. Both linkage plates 4.3 are supported rotatably on frame 1.

Linkage plates 4.3 are configured to translate a translational motion of the brackets 4.1, 4.2 into a tilting motion of mandrel 2. Linkage plate 4.3 located on the outwardly facing side of the tiltable mounting device 10 in FIG. 1 has typically the same geometric structure as linkage plate 4.3 shown in FIG. 1. The disclosure pertaining to the construction of the linkage plate 4.3 on the inwardly facing side of the tiltable mounting device 10 in FIG. 1 applies equally to linkage plate 4.3 positioned on the outwardly facing side.

Both linkage plates 4.3 are rigidly coupled to a respective rotation shaft (not shown) via which linkage plates 4.3 are supported rotatably on frame 1. As can be seen from e.g. FIG. 2E, the rotation shafts are rigidly connected to swing arms 2.3, which are rigidly connected to mandrel mounting plate 2.1 on which mandrel 2 is mounted. Rotation of linkage plates 4.3 around the rotational axis defined by the rotation shafts effects a swinging motion of swing arms 2.3 and thus a tilting motion of mandrel 2 mounted on mounting plate 2.1. The position of the rotational axis coincides with center hole 4.3.3 of linkage plate 4.3 indicated in FIG. 1. The rotational axis does typically not intersect with the longitudinal axis of mandrel 2, but is off-set with respect to the longitudinal axis of mandrel 2.

Figure 2A:
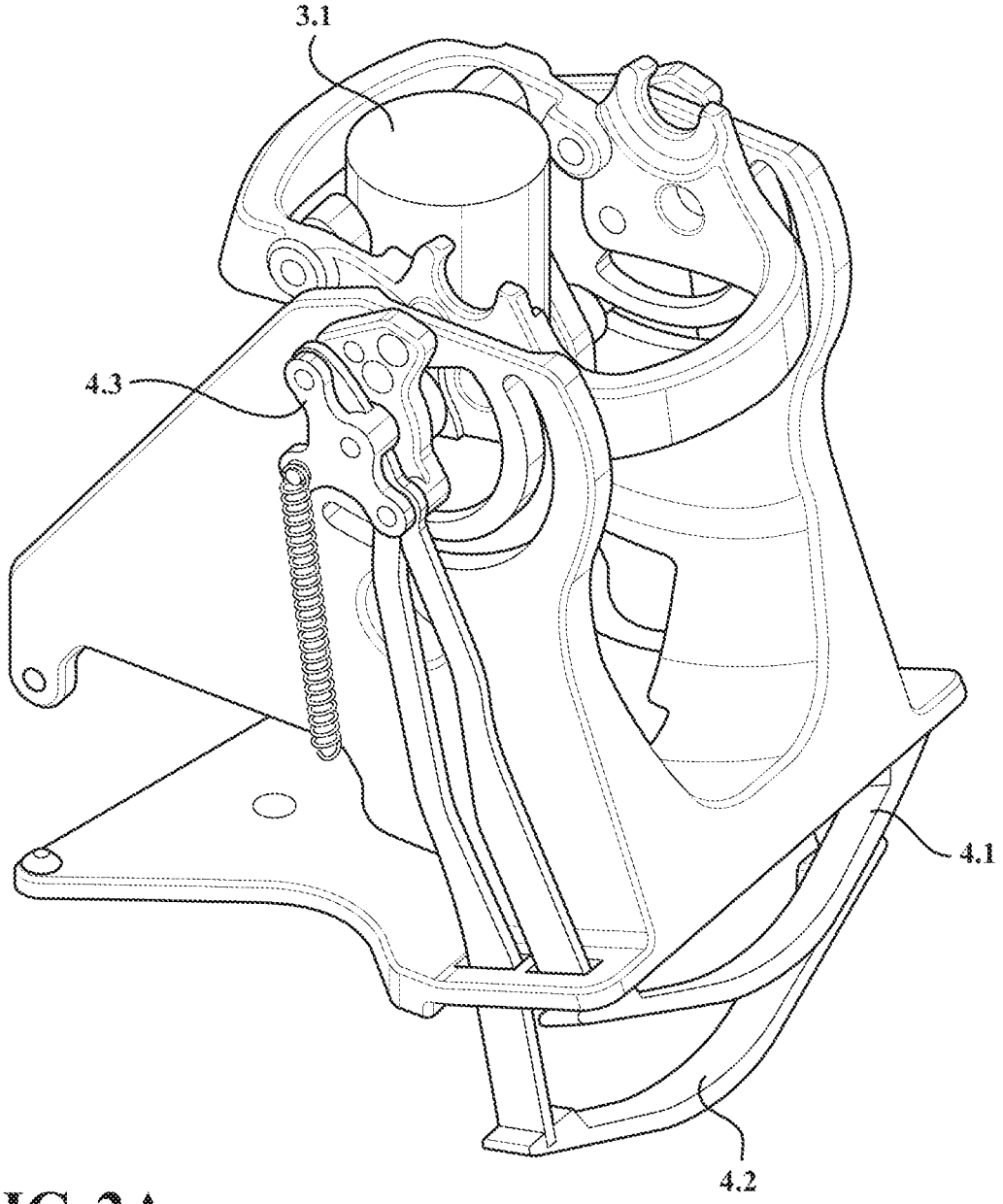
FIGS. 2A to 2E illustrate a tilting motion of the mandrel in the tiltable mounting device of FIG. 1 from a first position and to a second position.
Figure 2B:
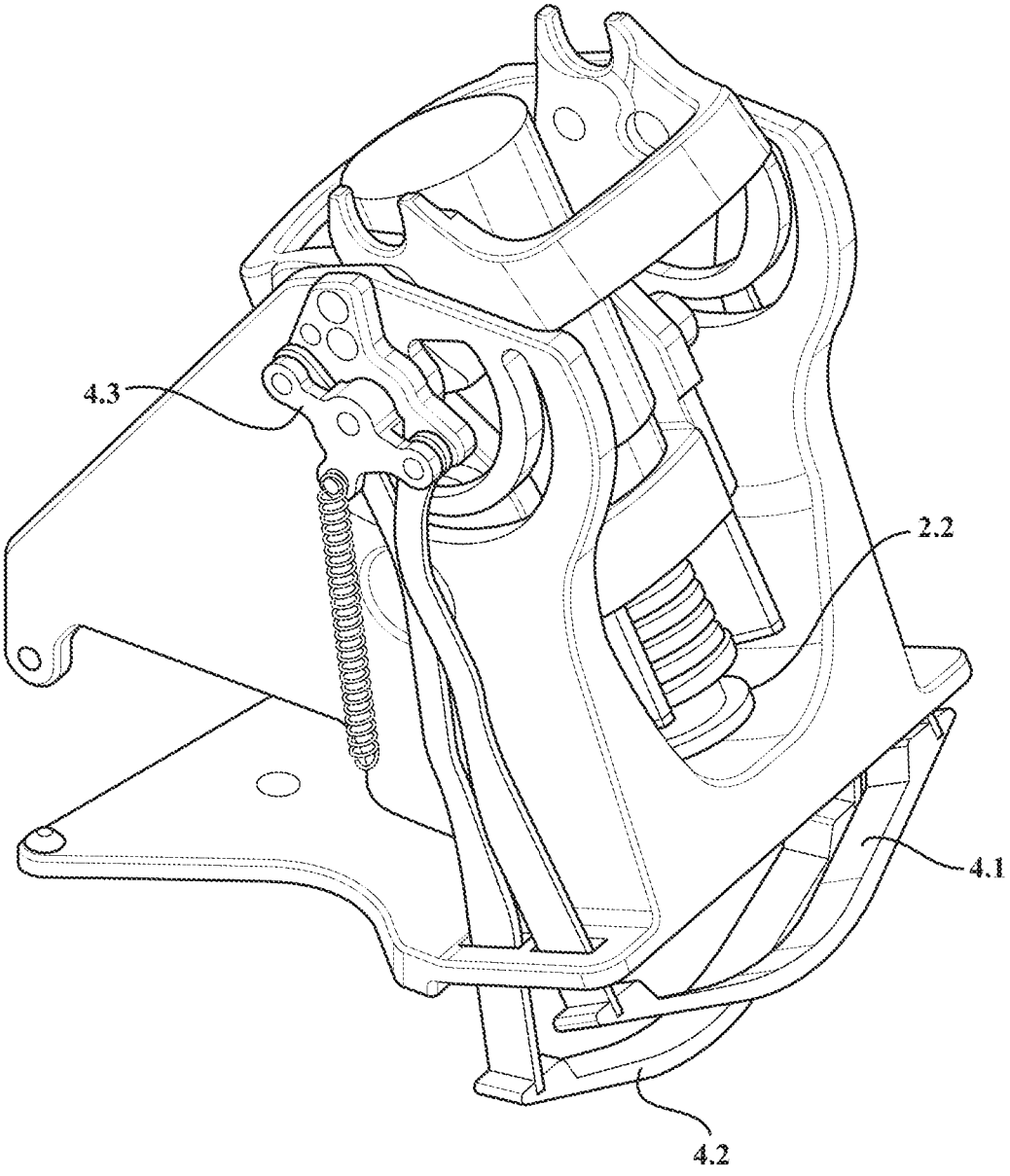
Figure 2C:
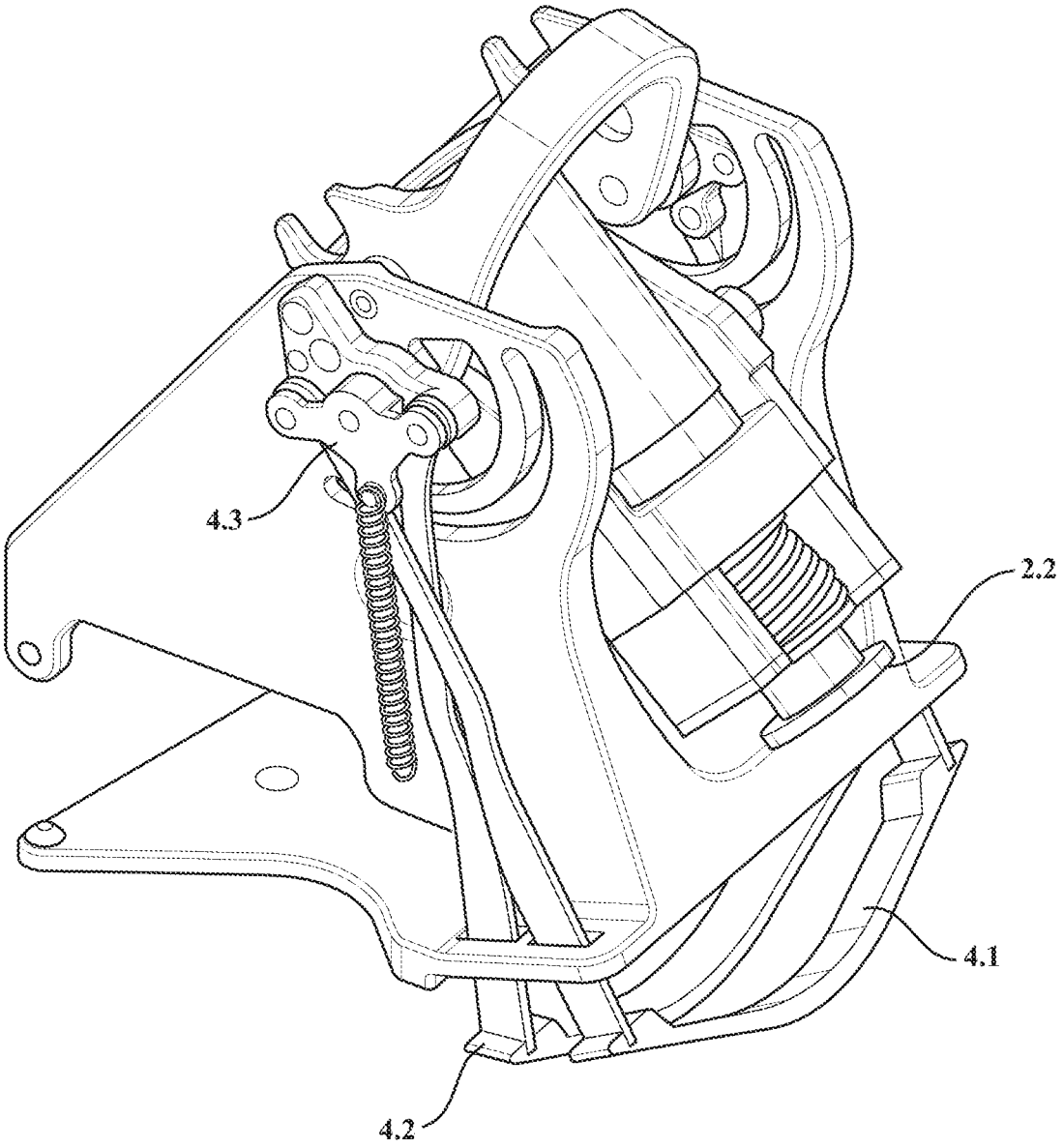
Figure 2D:
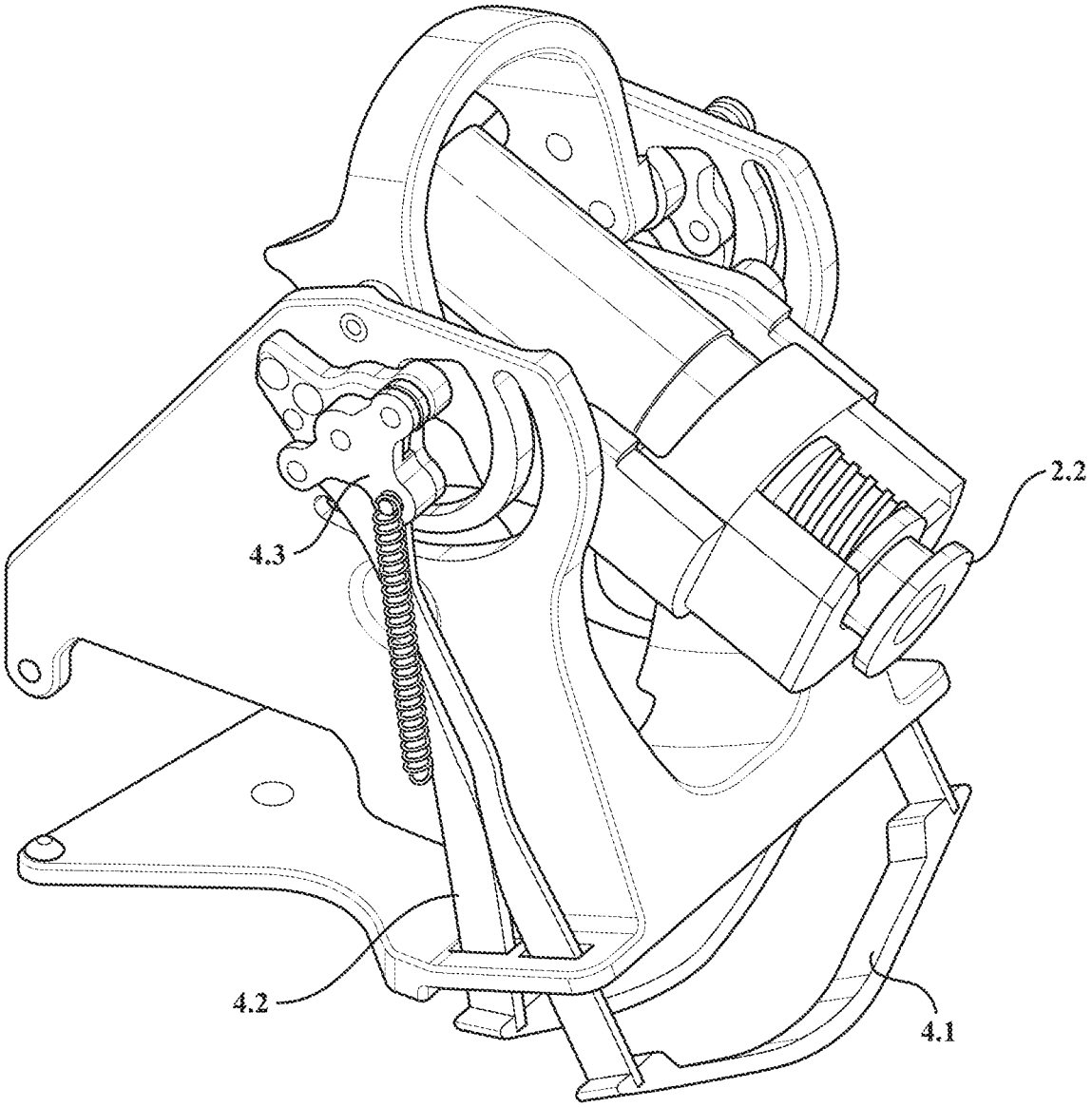

FIG. 2A to 2E are perspective views of the tiltable mounting device 10 of FIG. 1 with mandrel 2 and cylindrical object 3 mounted thereon depicted in subsequent tilting positions. FIG. 2A shows mandrel 2 with cylindrical object 3, with top surface 3.1 of cylindrical object 3 protruding over the top of the tiltable mounting device 10. That position represents one end position of the tilting motion of the mandrel 2 and is referred to as "first" position in the following. The plane of top surface 3.1 of cylindrical object 3 is referred to as reference plane in FIG. 2A.

Figure 2E:
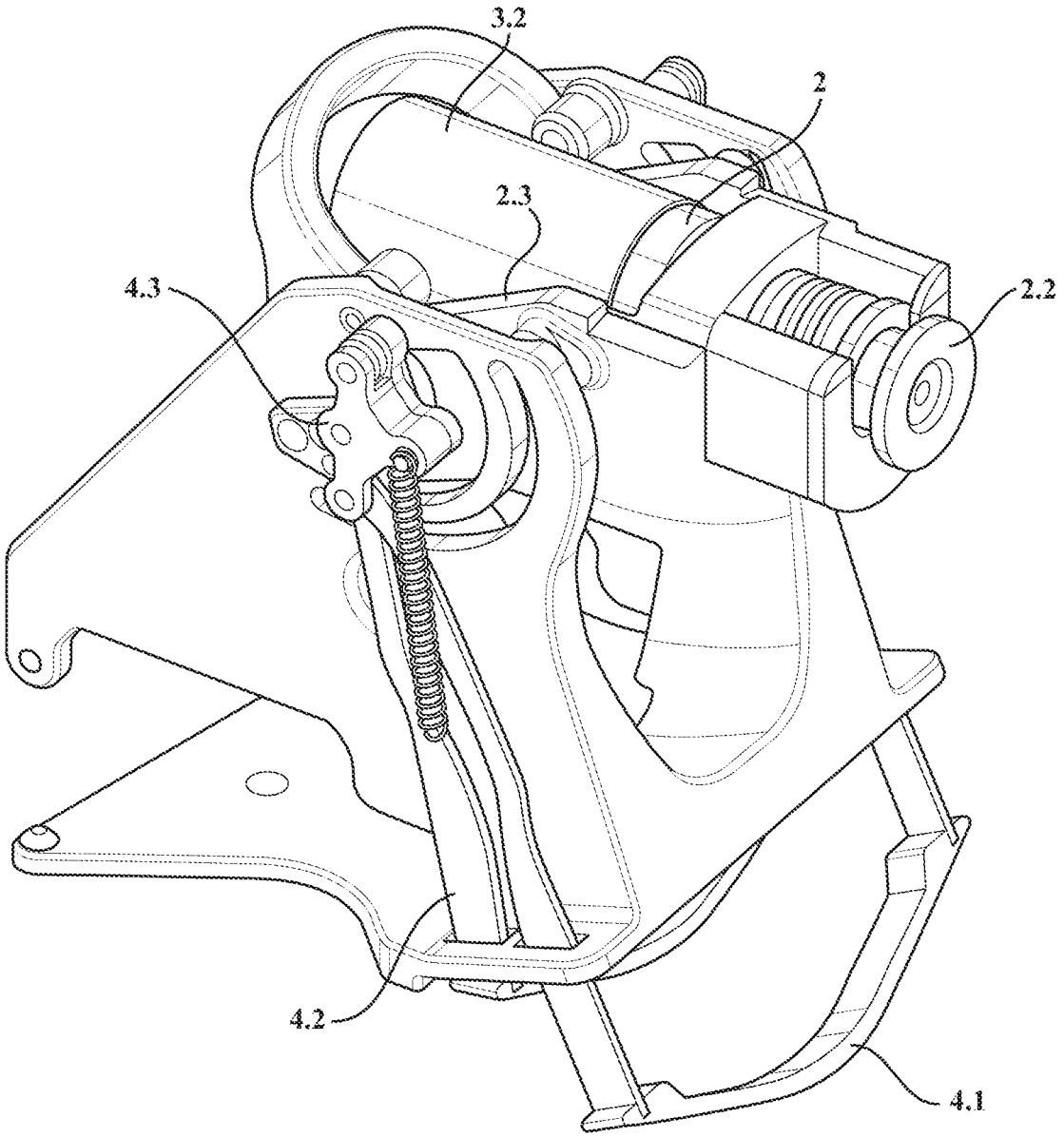

FIG. 2E shows the mandrel 2 with the cylindrical object 3 with lateral surface 3.2 of cylindrical object 3 mounted on mandrel 2 being tangent to the reference plane defined by the orientation of top surface 3.1 of cylindrical object 3 in the first position shown in FIG. 2A. That position is referred to as "second" position in the following.

Linkage plate 4.3 is configured such that, in the first position, first bracket 4.1 that is hingeably connected to linkage plate 4.3 via connection section 4.3.1 is pulled in an upward direction by the rotational position of linkage plate 4.3. The lower portion of bracket 4.1 that protrudes beyond the bottom section of frame element 1.2 is thus fully retracted in the first position shown in FIG. 2A.

Second bracket 4.2 is hingeably connected to the other connection section 4.3.2 that lies across the rotational axis of the linkage plate 4.3 from connection section 4.3.1 of the first bracket 4.1. Thus, in the first position shown in FIG. 2A, second bracket 4.2 is pushed downwardly by linkage plate 4.3 such that second bracket 4.2 maximally protrudes beyond the bottom section of frame element 1.2.

In contrast, in the second position of FIG. 2E, the lower portion of first bracket 4.1 is fully extended with respect to frame element 1.2, while the lower portion of second bracket 4.2 is fully retracted.

The successive representation of the tilting motion by FIG. 2A to 2E shows the tilting motion of cylindrical object 3 mounted on mandrel 2 from the first position to the second position. The tilting motion may be initiated by either pulling first bracket 4.1 outwardly or pushing second bracket 4.2 inwardly. The reverse motion from the second position to the first position can be effected either by pushing first bracket 4.1 inwardly or pulling second bracket 4.2 outwardly.

FIGS. 1 and 2A to 2E further show spring 4.8 that is connected to linkage plate 4.3. The loose end of the spring 4.8 may be connected to a holding structure (not shown) on frame 1, in order to preload spring 4.8 and force linkage plate 4.3 to a predetermined position, depending on the position of holding structure relative to the rotational axis of linkage plate 4.3. Thereby, mandrel 2 is forced to a predetermined position as well. The position of the holding structure could be chosen such that the mandrel's forced, predetermined position is either the first position, or the second position, or a position in between these end positions.

The mechanism for tilting mandrel 2 from the first position to the second position described above can be modified in various ways without departing from the scope of the present invention. The swinging motion of swing arms 2.3 around the rotational axis defined by the rotation shafts could also be actuated by motors realized on frame 1 that directly drive the rotation shafts. Alternatively, one of brackets 4.1, 4.2 may be used only to translate the translational motion of the bracket into a rotational motion of linkage plate 4.3.

Various other mechanical linkages for the generation of the tilting motion are conceivable provided that the tilting motion of mandrel 2 is carried out such that cylindrical object 3 mounted on mandrel 2 is tiltable from a first position to a second position. Thereby, in the first position, top surface 3.1 of cylindrical object 3 lies in a reference plane, whereas in the second position, lateral surface 3.2 of cylindrical object 3 is tangent to the reference plane defined by the orientation of top surface 3.1 in the first position.

By FIG. 2B to 2E, rotation coupling 2.2 on the bottom of mandrel mounting plate 2.1 is shown. Rotation coupling 2.2 is configured to interface with a rotational force generator (not shown) such as a rotational motor or servo actuator, in order to rotate mandrel 2 around its longitudinal axis. By rotating mandrel 2 around its rotational axis, cylindrical object 3 mounted thereon is also set into rotation around its longitudinal axis. Rotation coupling 2.2 can alternatively be replaced by a rotational motor that is attached to mandrel mounting plate 2.1. It directly generates the rotational force required to rotate mandrel 2.

With tiltable mounting device 10 described above, cylindrical object 3 mounted on the mandrel 2 can be tilted into the first position such that the top surface 3.1 of cylindrical object 3 lies in the reference plane. A rotation of mandrel 2 around its longitudinal axis effects a rotation of top surface 3.1 in the reference plane. Subsequently, cylindrical object 3 can be tilted to the second position by tilting the mandrel to the position shown in FIG. 2E. When rotating mandrel 2 around its longitudinal axis in the second position, each segment of lateral surface 3.2 of cylindrical object 3 is brought into contact with the reference plane.

If a printhead (not shown) is positioned such that it can print in the reference plane, the entire cylindrical object 3 can be printed by performing the tilting motion of mandrel 2 described above. That is, mandrel 2 with cylindrical object 3 is tilted to the first position. Thus, top surface 3.1 of the cylindrical object can be printed. At that moment, mandrel 2 may be rotated around its longitudinal axis. Then, mandrel 2 with cylindrical object 3 is tilted to the second position. Now, lateral surface 3.2 of cylindrical object 3 is tangent to the reference plane, such that the tangent section of lateral surface 3.2 can be printed. By rotating mandrel 2 around its longitudinal axis in the second position, the entire lateral surface 3.2 of cylindrical object 3 comes successively into contact with the reference plane and can thus be printed.

If the tiltable mounting device 10 is configured to be movable parallel to the reference plane, it is also possible to print the entire top surface 3.1 of the cylindrical object 3 by moving the tiltable mounting device 10 parallel to the reference plane whilst the mandrel 2 is in the first position.

The frame may comprise one or more alignment elements 1.5, one of which is shown in FIG. 1. When the tiltable mounting device 10 is to be aligned with a printhead (not shown), a high positioning precision is required in order to allow for a reproducible and high printing quality. The alignment aid 1.5 is formed as a protrusion of defined shape that is configured to engage with a complementary shaped alignment aid that is arranged in a fixed position and orientation with respect to the printhead (not shown), so that the tiltable mounting device can be reproducibly and reliably positioned in a fixed position relative to the printhead.

With tiltable mounting device 10 according to the first embodiment described above, a cylindrical object 3 with top surface 3.1 and lateral surface 3.2, such as a screw cap, can be printed on its entire surface by only one printhead. Obviously, the order of the steps described above may also be altered such that mandrel 2 is first tilted to the second position, printing on lateral surface 3.2, and mandrel 2 is subsequently tilted to the first position, thus printing on top surface 3.1.

Figure 3:
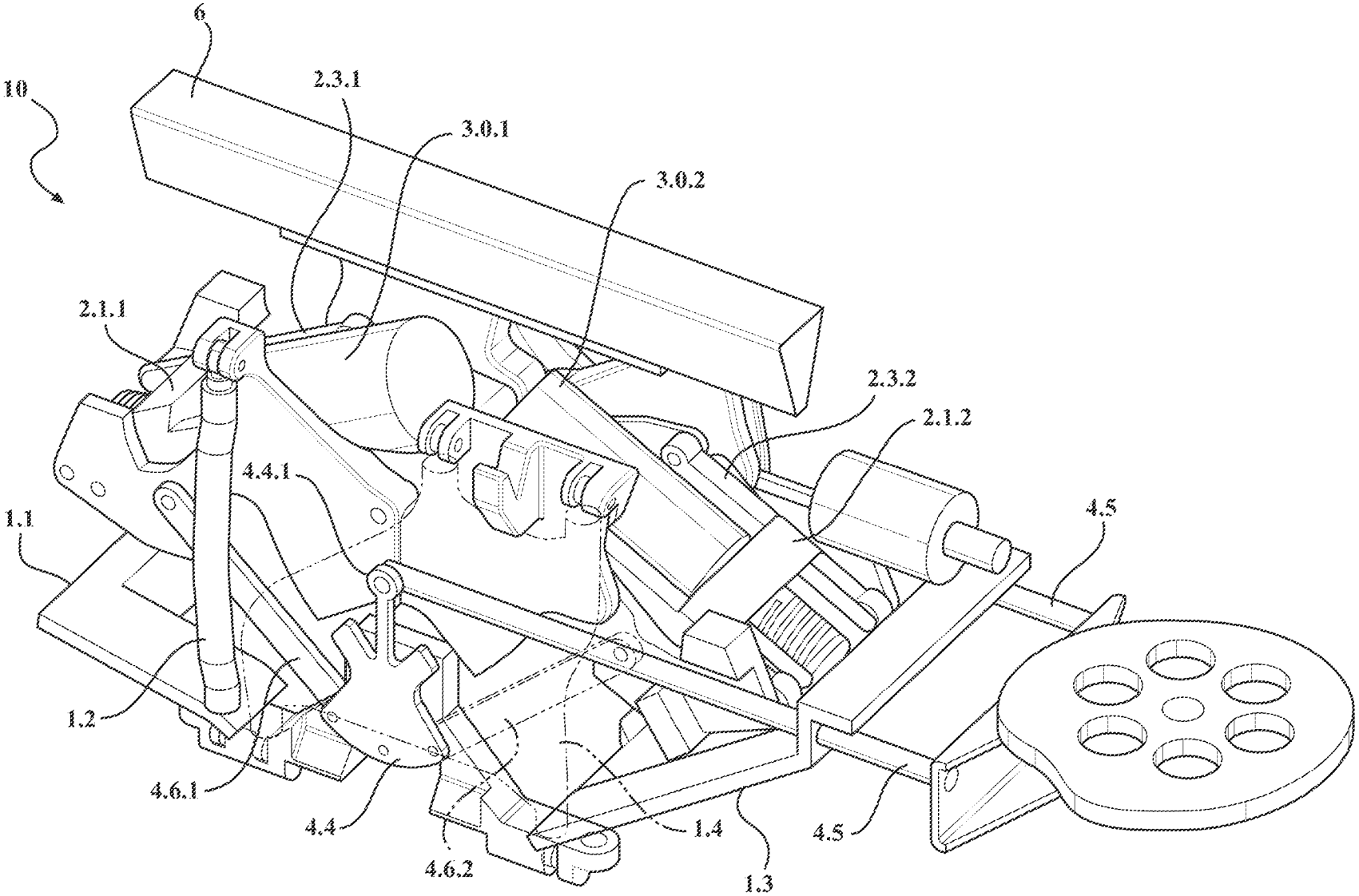
FIG. 3 shows a perspective view of a tiltable mounting device according to a second embodiment of the present invention together with a printhead.

FIG. 3 shows a perspective view of tiltable mounting device 10 according to a second embodiment of the present invention. Tiltable mounting device 10 of the second embodiment comprises two mandrels 2.0.1 and 2.0.2 on which a first and a second cylindrical object 3.0.1 and 3.0.2 can be mounted. FIG. 3 shows tiltable mounting device 10 with both the first and second cylindrical object 3.0.1 and 3.0.2 mounted. First cylindrical object 3.0.1 is mounted on first mandrel 2.0.1 (not shown in FIG. 3). Second cylindrical object 3.0.2 is mounted on second mandrel 2.0.2 (also not shown in FIG. 3). First and second mandrels 2.0.1, 2.0.2 are configured as expanding mandrels, analogously to mandrel 2 of the first embodiment.

Frame 1 of tiltable mounting device 10 in FIG. 3 comprises multiple frame portions 1.1 to 1.4 that are connected to form rigid frame 1 that serves as support structure for the tilting mechanisms of first mandrel 2.0.1 and second mandrel 2.0.2. Frame portion 1.3 serves as guiding structure for an actuating element that is configured by two actuating rods 4.5 that are slidably supported on frame portion 1.3 through holes in frame part 1.3.

Frame portion 1.4 is depicted as a transparent structure in FIG. 3 to show the structure underneath. Actuating rods 4.5 are each hingeably connected to actuated extension 4.4.1 of linkage plate 4.4. It is noted that second linkage plate 4.4 positioned on the outwardly facing side of tiltable mounting device 10 in FIG. 3 is not shown. However, the entire tiltable mounting device 10 is designed symmetrically with respect to a plane in between actuating rods 4.5. The description pertaining to the construction of the inwardly facing side of tiltable mounting device 10 in FIG. 3 applies equally to the symmetric outwardly facing side.

Linkage plate 4.4 is supported rotatably on frame 1 around a rotational axis that intersects linkage plate 4.4 essentially at its center of gravity. Actuated extension 4.4.1 serves to transmit a translational force exerted by the actuating rod 4.5 onto linkage plate 4.4 and translate it into a rotational motion of the linkage plate 4.4 around the rotational axis. Conceptually, the function of linkage plate 4.4 thus corresponds to that of linkage plate 4.3 in the first embodiment.

Figure 4A:
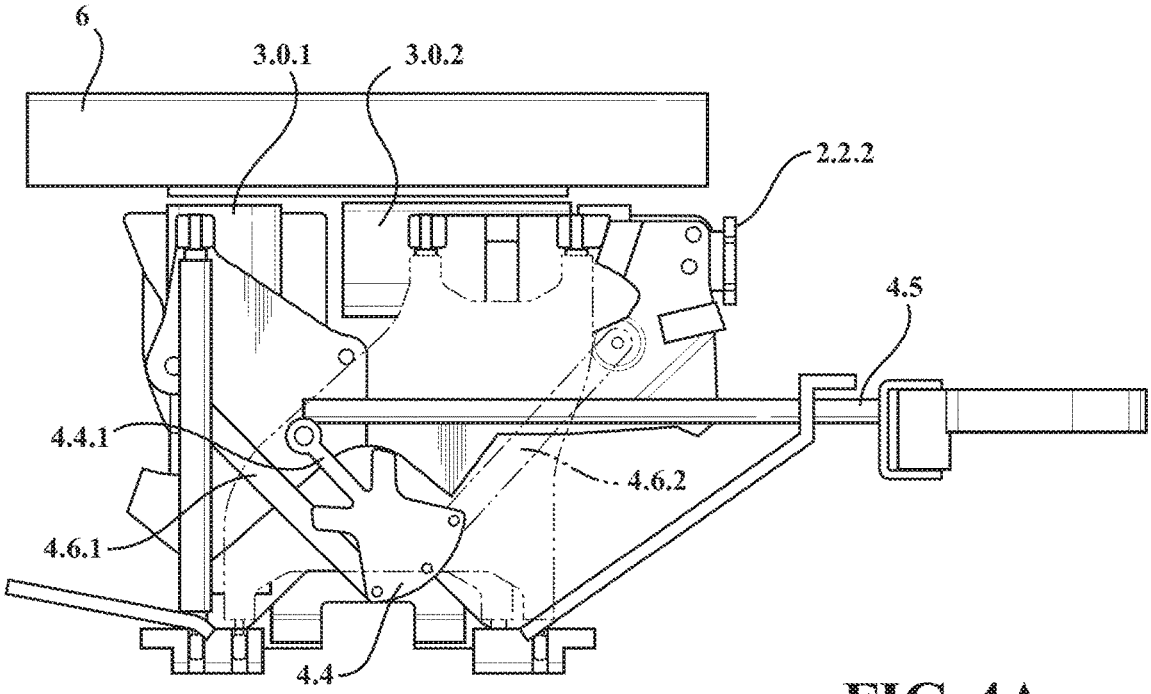
FIGS. 4A to 4F illustrate a tilting motion of the mandrels in the tiltable mounting device of FIG. 3 from their respective first to their second positions.
Figure 4B:
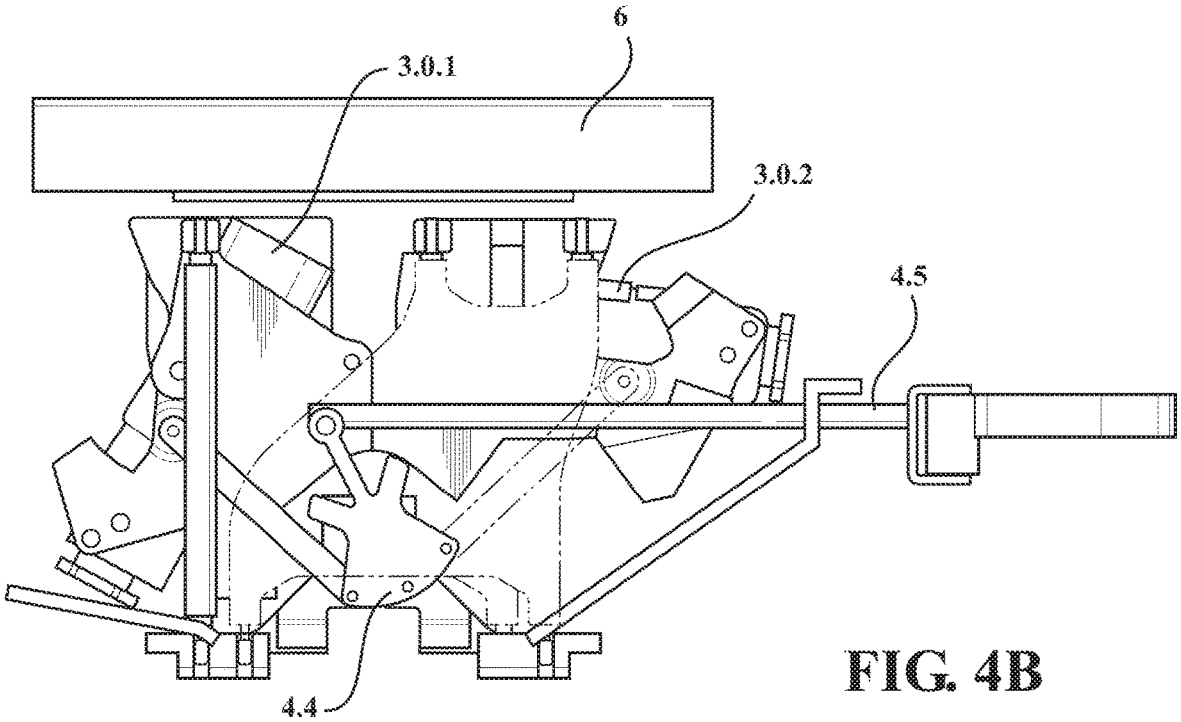
Figure 4C:
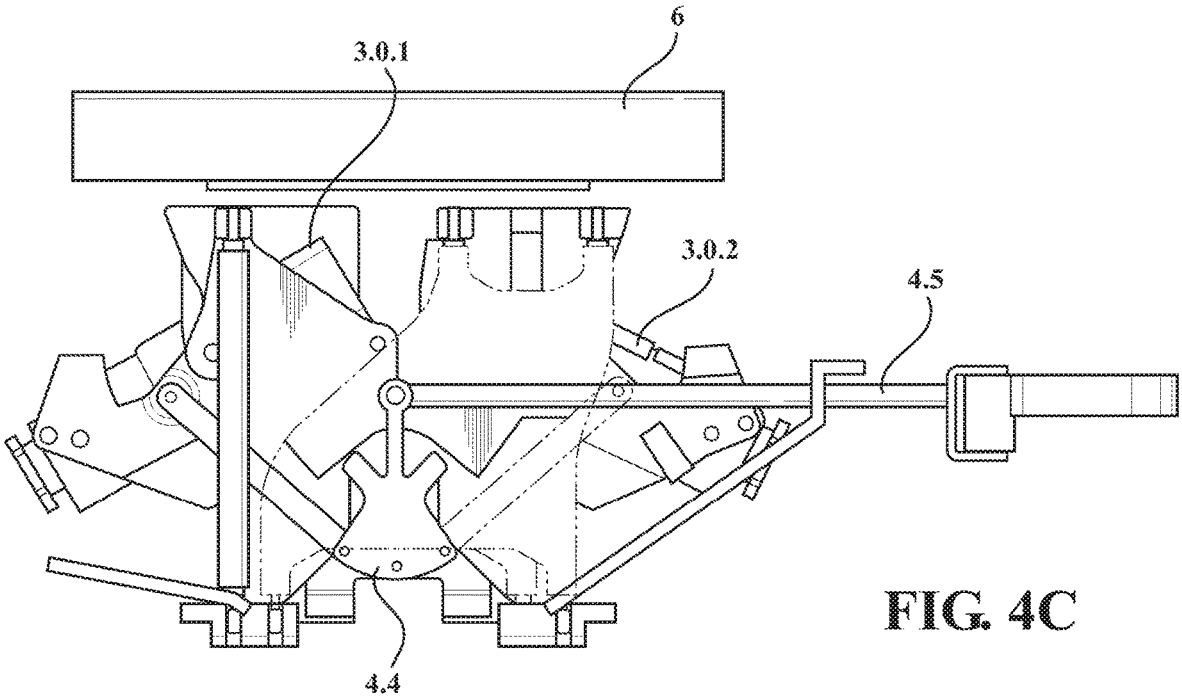
Figure 4D:
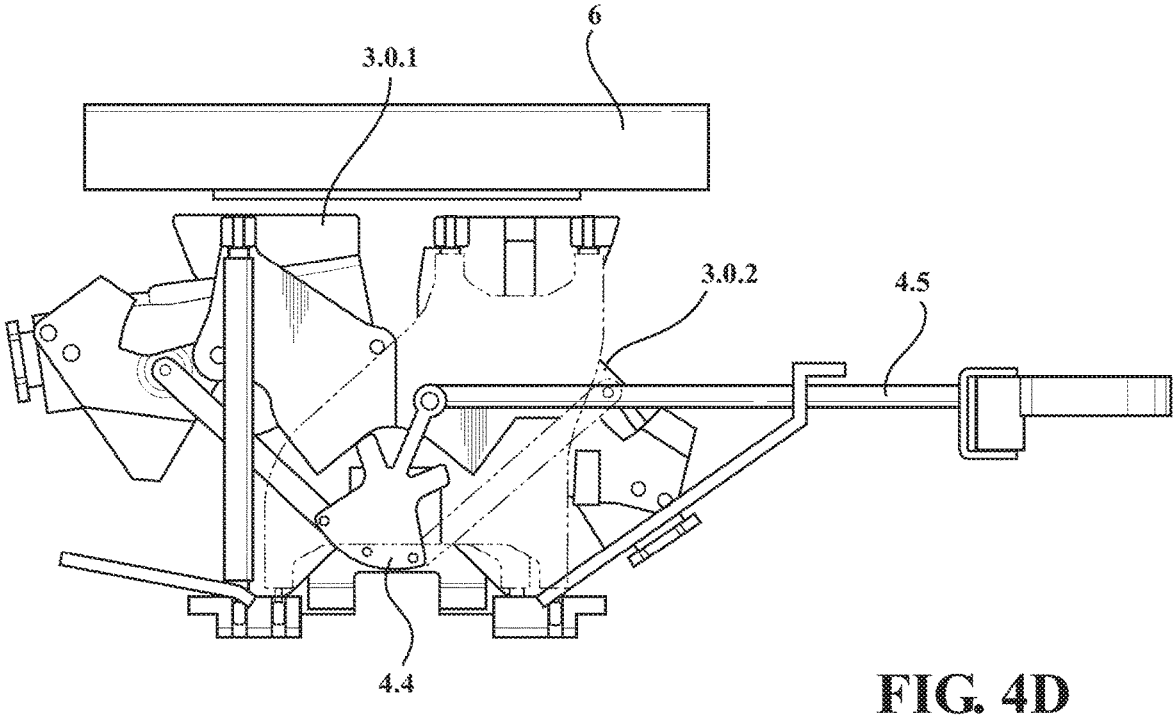
Figure 4E:
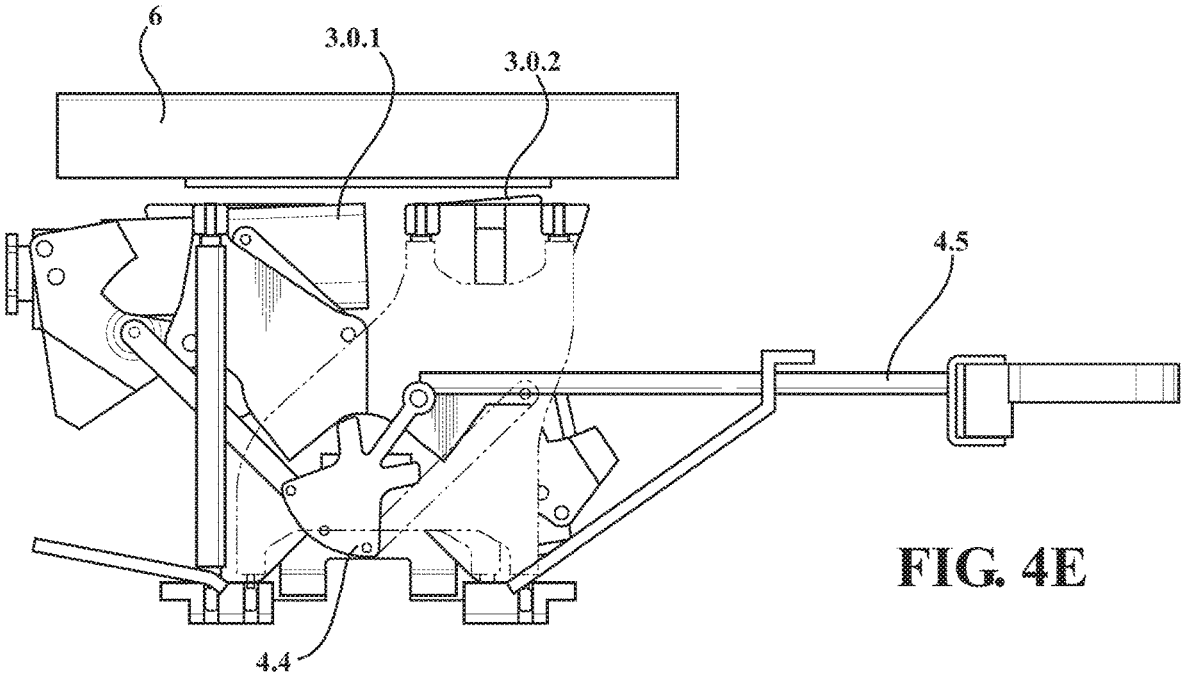
Figure 4F:
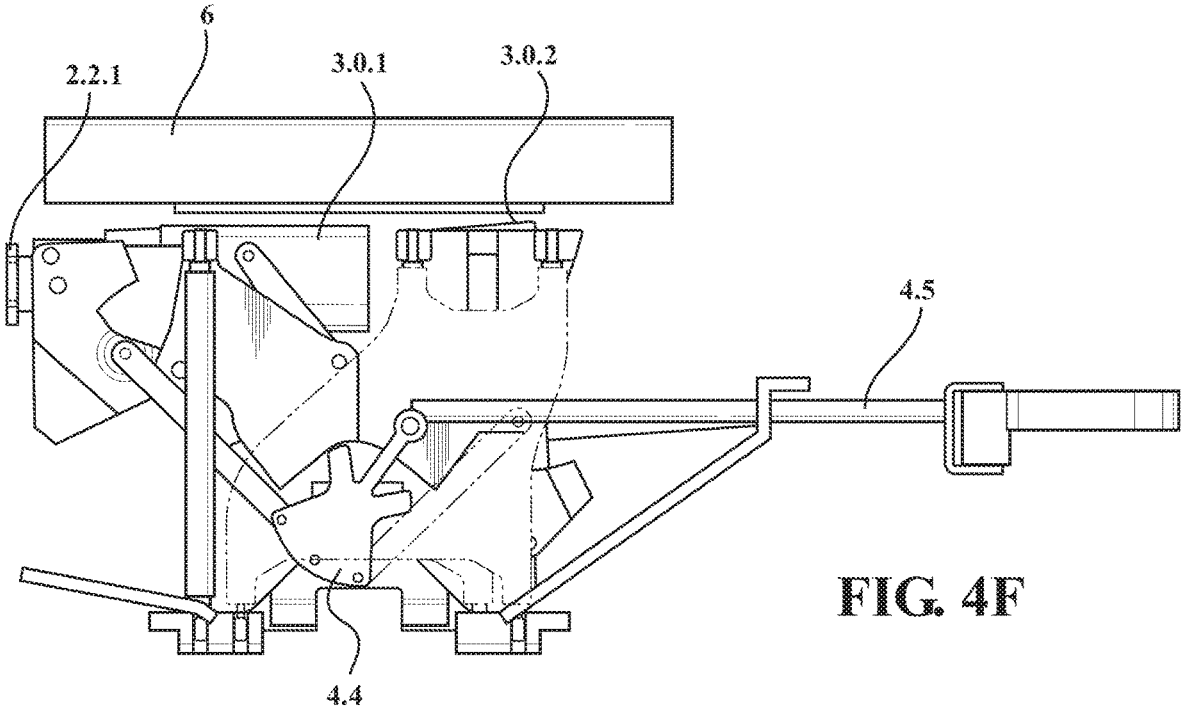

FIG. 4A to 4F depict various configurations in a series of positions of tiltable mounting device 10 that are realized when actuating rod 4.5 is pulled out from innermost position in FIG. 4A towards outermost position shown in FIG. 4F with respect to frame 1. The translational motion of actuating rod 4.5 is translated into a rotational motion of linkage plate 4.4 around the rotational axis by the linkage via actuated extension 4.4.1.

In analogy to the first embodiment, mandrels 2.0.1, 2.0.2 are mounted on respective mandrel mounting plates 2.1.1, 2.1.2 that are connected to swing supports 2.3.1, 2.3.2 that are hingeably supported on frame 1. Swing supports 2.3.1, 2.3.2 are hingeably coupled to linkage plate 4.4 via respective connecting bars 4.6.1, 4.6.2.

When actuating rod 4.5 is moved from the position in FIG. 4A to the position in FIG. 4F, a force is transmitted from linkage plate 4.4 via connecting bars 4.6.2, 4.6.2 onto swing supports 2.3.1, 2.3.2. In consequence, mandrels 2.0.1, 2.0.2 are tilted. In the initial configuration shown in FIG. 4A, first mandrel 2.0.1 is in its first position, i.e., the top surface of the cylindrical object 3.0.1 mounted thereon lies in the reference plane. The second mandrel 2.0.2 is in its second position, i.e., the lateral surface of cylindrical object 3.0.2 mounted thereon is tangent to the reference plane.

In FIGS. 4A and 4F, second and first rotation couplings 2.2.2 and 2.2.1 for second mandrel 2.0.2 and first mandrel 2.0.1 are shown. As in the first embodiment, rotation couplings 2.2.1 and 2.2.2 are configured to interface or interact with a respective rotational force generator (not shown) such as a rotational motor or servo actuator, in order to rotate mandrels 2.0.1 and 2.0.2 around their longitudinal axes. Thereby, mounted cylindrical objects 3.0.1, 3.0.2 are set to rotation around their longitudinal axis. The rotation couplings may be replaced by rotational motors that are attached to the respective mandrel mounting plates to directly generate the rotational force required to rotate mandrels 2.0.1, 2.0.2.

From FIG. 4A to 4F it is evident that the reference planes of first cylindrical object 3.0.1 and second cylindrical object 2.0.2 coincide. Thus, printhead 6 configured to print in the reference plane can be used to print on both the first cylindrical object 3.0.1 and the second cylindrical object 3.0.2. In the first position, the top surface of first cylindrical object 3.0.1 is printed simultaneously with the lateral surface of second cylindrical object 3.0.2, while both mandrels are rotated around their longitudinal axes. In the second position, the lateral surface of first cylindrical object 3.0.1 is printed simultaneously with the top surface of second cylindrical object 3.0.2, while both mandrels are rotated around their longitudinal axes. If the tiltable mounting device 10 is configured to be movable parallel to the reference plane, it is also possible to print the entire top surfaces 3.0.1, 3.0.2 by moving the tiltable mounting device parallel to the reference plane whilst the respective mandrels 2.0.1, 2.0.2 are in their first position.

The starting position of the mandrels may be freely chosen, e.g. the first or second position, such that the top surface of second (or first) cylindrical object 3.0.2 and the lateral surface of first (or second) cylindrical object 3.0.1 are initially printed. Since the tilting motion of mandrels 2.0.1, 2.0.2 are controlled by the lateral motion of the actuating rods 4.5 in a synchronized manner, it is ensured that both cylindrical objects 3.0.1, 3.0.2 are printed simultaneously when actuating rod 4.5 is either in its fully extended position or in its fully retracted position.

Further hingeable linkages may be provided between connecting bars 4.6.1, 4.6.2 and swing arms 2.3.1, 2.3.2. By a multi-joint structure, the tilting motion of mandrels 2.0.1, 2.0.2 may be modified such that, when mandrels 2.0.1, 2.0.2 are tilted away from the first or second positions, the motion of mandrels 2.0.1, 2.0.2 is initially substantially perpendicular to the reference plane. Thereafter, inclination of the longitudinal axes of mandrels 2.0.1, 2.0.2 changes. Such an arrangement has the advantage that any interference resulting from the tilting motion of the cylindrical objects 3.0.1, 3.0.2 mounted on mandrels 2.0.1, 2.0.2 with printhead 6 may be reduced or avoided, whenever mandrels 2.0.1, 2.0.2 are tilted from their respective first to their second position.

As in the previous embodiment, the frame 1 may comprise one or more alignment elements 1.5 (not shown) that allow a reproducible, mechanical alignment relative to a printhead with high precision.

Figure 5:
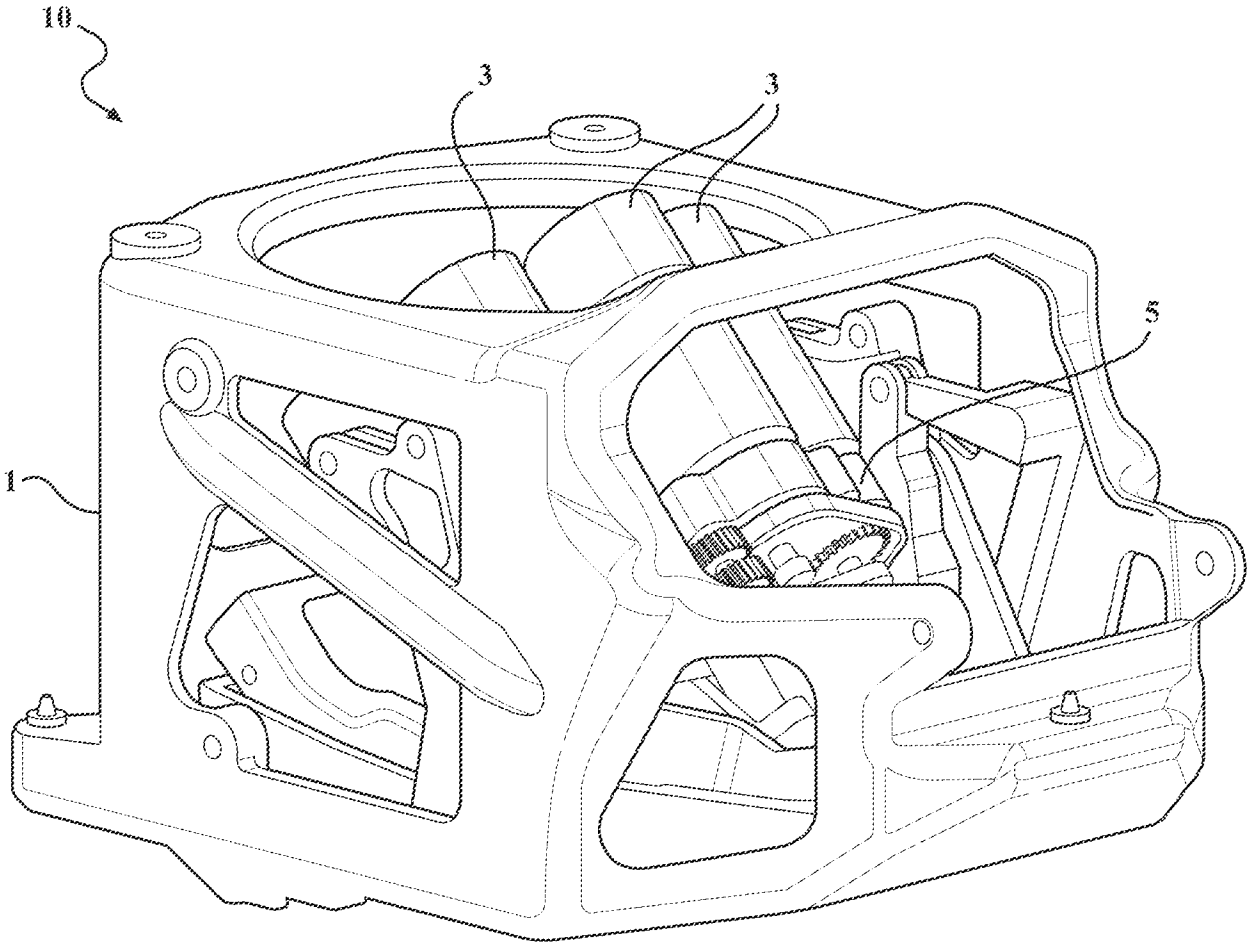
FIG. 5 shows a perspective view of a tiltable mounting device according to a third embodiment of the present invention.

FIG. 5 shows a perspective view of tiltable mounting device 10 according to a third embodiment of the present invention. In this embodiment, tiltable mounting device 10 comprises a plurality of mandrels 2 for mounting cylindrical objects 3. Mandrels 2 are configured as expanding mandrels as for the previous embodiments. The embodiment shown in FIG. 5 comprises seven mandrels 2 on which seven cylindrical objects 3 may be mounted.

Seven mandrels 2 are arranged in a circular arrangement on rotary disc 5. Analogously to the mandrels of the first and second embodiments, rotary disc 5 as a whole is tiltable in frame 1 between a first and a second position. The frame 1 may comprise multiple alignment elements 1.5, two of which are shown in FIG. 5, for aligning the tiltable mounting device 10 relative to a stationary printhead (not shown). FIG. 5 shows rotary disc 5 in the first position, in which the top surfaces of all seven mounted cylindrical objects 3 lie in a common reference plane. Thus, with rotary disc 5 in the first position, all mandrels 2 mounted on the rotary disc 5 are in a position that corresponds to the first position of the mandrels in the first and second embodiments.

Figure 6A:
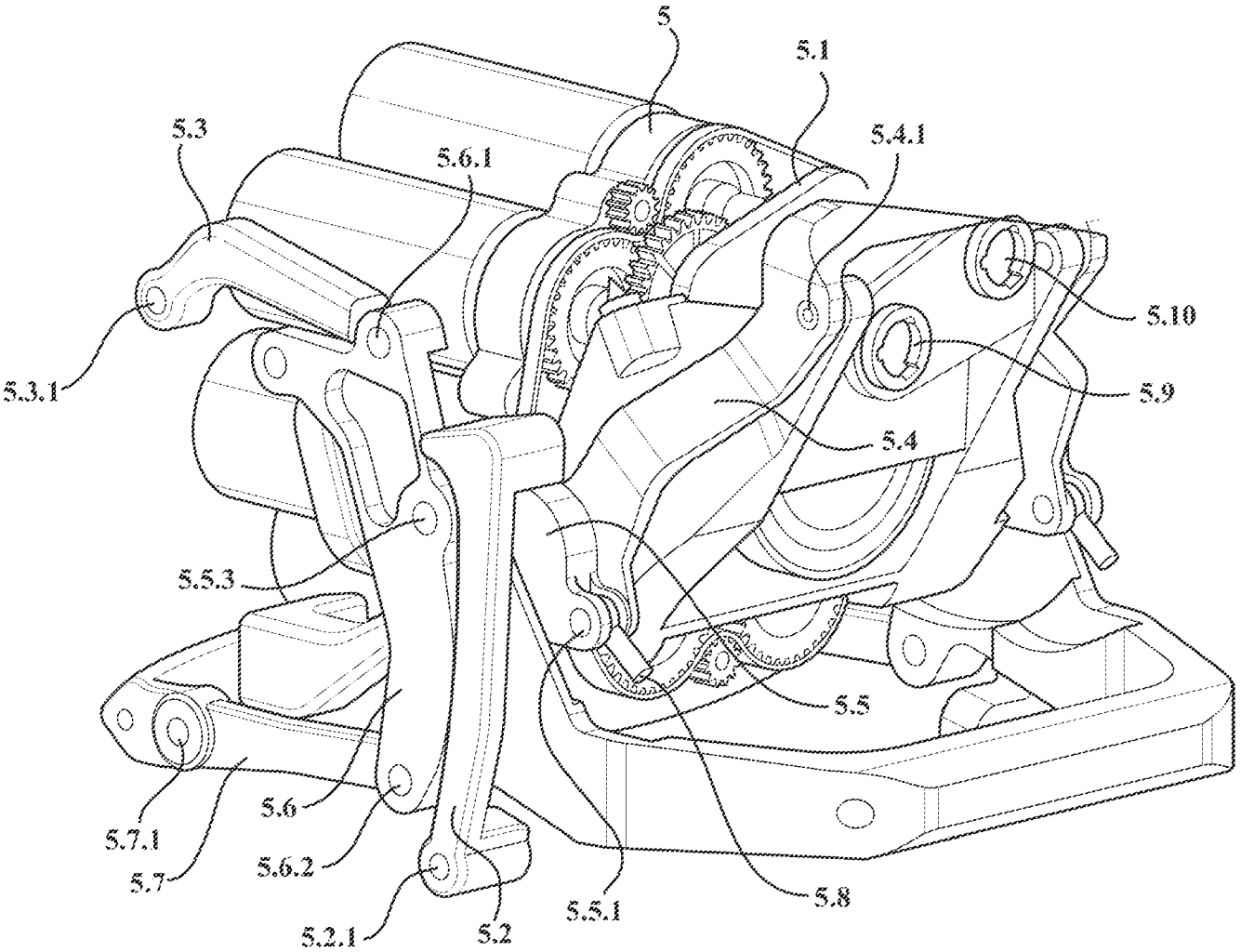
FIGS. 6A to 6C illustrate a tilting motion of a rotary disc and mandrels in the tiltable mounting device of FIG. 5 from their first to their second positions.
Figure 6B:
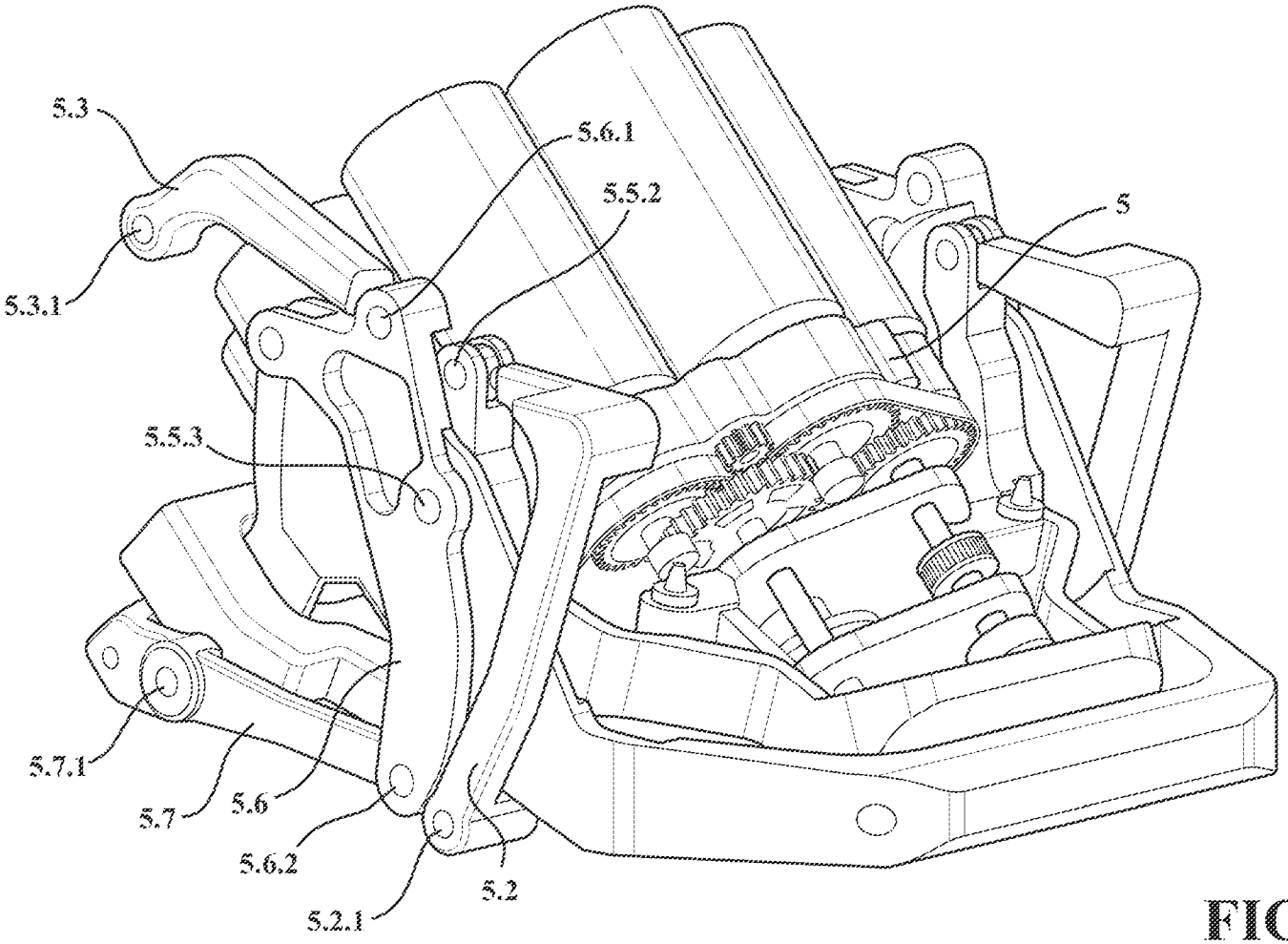
Figure 6C:
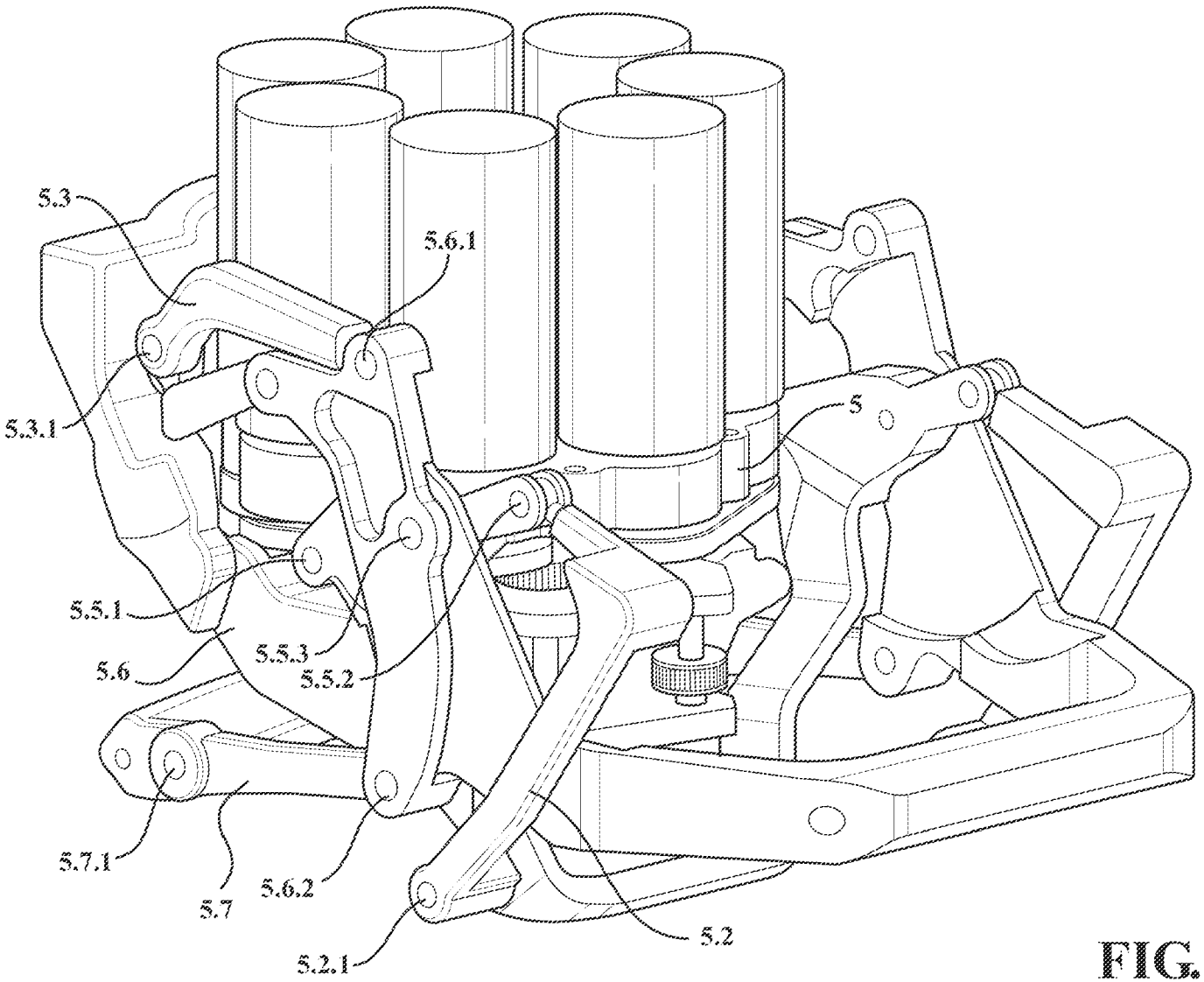

FIG. 6A to 6C illustrate a tilting motion of rotary disc 5 from the second position to the first position. Rotary disc 5 is supported hingeably in frame 1. For ease of illustration, frame 1 is omitted in FIG. 6A to 6C. As in the first and second embodiments, the linkage construction is symmetrical such that elements on the inwardly facing side of FIG. 6A to 6C are also provided on the outwardly facing side. In order to facilitate the description, reference is only made to the inwardly facing linkage elements that are shown in FIG. 6A to 6C. The features of the inwardly facing linkage elements apply equally to the linkage elements on the outwardly facing side of FIG. 6A to 6C.

In FIG. 6A, rotary disc 5 is depicted in its second position, whereby the longitudinal axes of mandrels 2 and, thus, cylindrical objects 3 lie parallel to the reference plane. As can be retrieved from FIG. 6A, rotary disc 5 is mounted on rotary disc mounting element 5.1. Rotary disc mounting element 5.1 is hingeably connected to swing arm 5.4 via joint 5.4.1. Swing arm 5.4 is hingeably connected to swing plate 5.5 via joint 5.5.1. Swing plate 5.5 comprises two further joints 5.5.2 and 5.5.3. Joint 5.5.2 (shown in FIG. 6C) is hingeably connected to first joint arm 5.2, the other end of which is hingeably connected to frame 1 via joint 5.2.1. Joint 5.5.3 is hingeably connected to second swing plate 5.6. Swing plate 5.6 comprises two further joints 5.6.1 and 5.6.2. Joint 5.6.1 is hingeably connected to second joint arm 5.3, the other end of which is hingeably connected to frame 1 via joint 5.3.1. Joint 5.6.2 is hingeably connected to third joint arm 5.7, the other end of which is hingeably connected to frame 1 via joint 5.7.1.

In FIG. 6A, a short stud-like extension 5.8 is depicted on joint 5.5.1. Extension 5.8 is hingeably coupled to swing plate 5.5 via a ball-joint or the like. An actuating device (not shown) may be coupled to extension 5.8. When joint 5.5.1 in FIG. 6A is pushed inwardly via the actuating device towards the direction of the facing of the top surfaces of cylindrical objects 3, swing plate 5.5 is rotated clockwise around joint 5.5.3. Such a rotation of swing plate 5.5 effects a tilting motion of rotary disc 5 downwards, while first joint arm 5.2 swings back and second swing plate 5.6 coupled to first swing plate 5.5 and second and third joint arms 5.3 and 5.7 move downwards to arrive at the configuration shown in FIG. 6B. When joint 5.5.1 is further pushed inwardly, the linkage configuration of joint arms 5.2, 5.3, 5.7 fixed to frame 1 to rotary disc 5 via swing plates 5.5, 5.6 and swing arm 5.4 effects a tilting motion of rotary disc such that the top surfaces of cylindrical elements 3 are pushed upwardly. As a result, rotary disc 5 tilts to its first position.

Thus, the multi-joint linkage between rotary disc 5 and frame 1 according to the third embodiment enables a tilting motion of rotary disc 5 from the first position to the second position and back to the first position as described above. In the first position, mandrels 2 on rotary disc 5 are oriented such that the top surfaces of all cylindrical objects 3 lie in the reference plane, such that the top surface of all cylindrical objects 3 are accessible for printing. In the second position, mandrels 2 are oriented with their longitudinal axes parallel to the reference plane. When rotating rotary disc 5 around its center, the lateral surfaces of cylindrical objects 3 are brought into contact with the reference plane.

With this configuration, each cylindrical object 3 may be positioned such that printing of the lateral surfaces with a printhead that is configured to print in the reference plane, is enabled. In order to print the entire lateral surface of cylindrical objects 3, each cylindrical object 3 has to be rotated around its longitudinal axis when it is tangent to the reference plane. Therefore, rotary disc 5 comprises a rotary mechanism for rotating rotary disc 5 itself, as well as a rotary mechanism for rotating individual mandrels 2 around their longitudinal axis. These rotating mechanisms are described in the following with reference to FIGS. 7 and 8.

Figure 7:
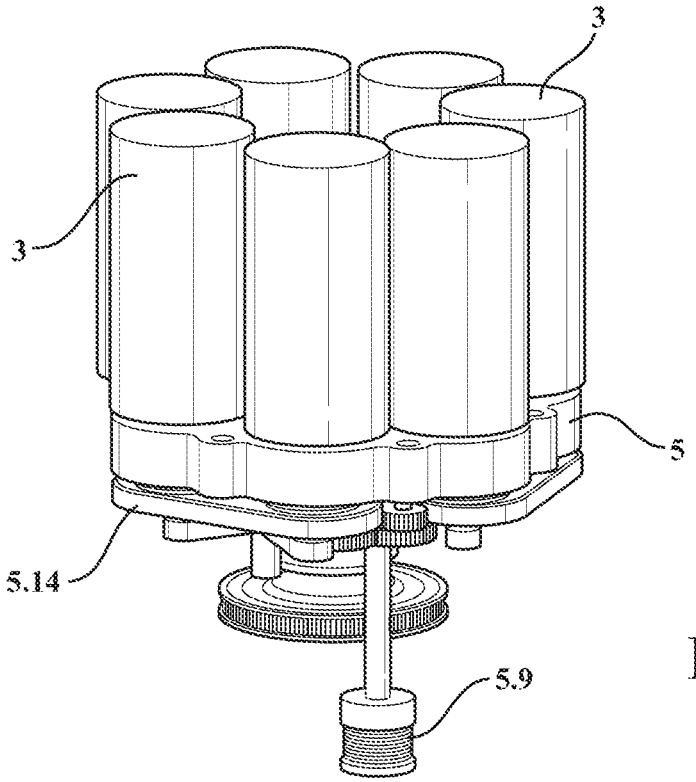
FIG. 7 shows a perspective view of the rotary disc with seven mandrels and seven cylindrical objects mounted thereon.
Figure 8A:
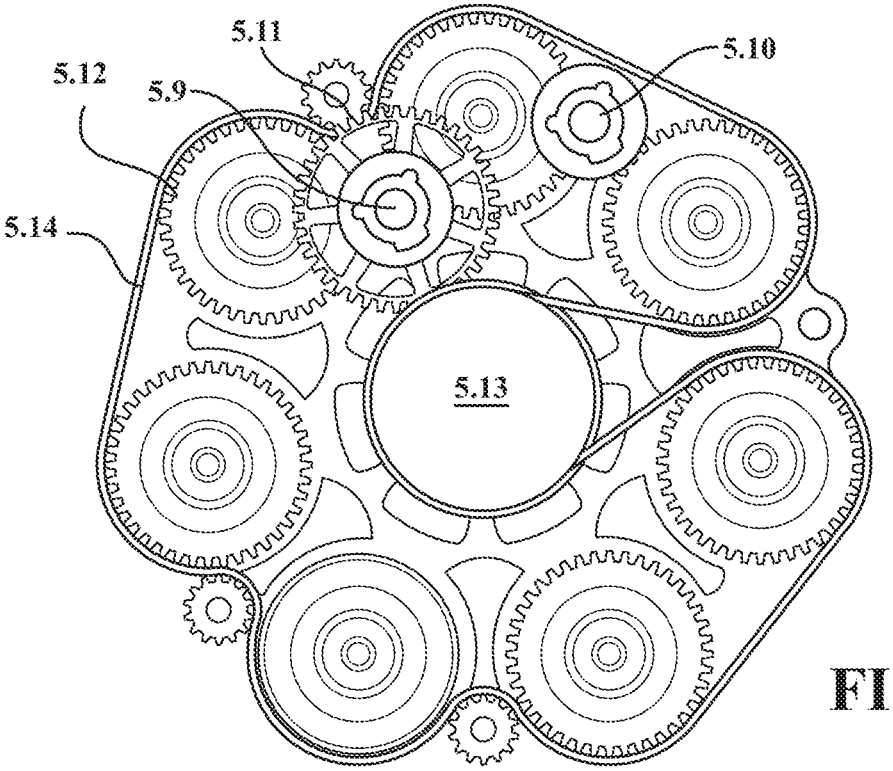
FIGS. 8A and 8B is a bottom view (FIG. 8A) of the rotary disc in FIG. 7, or a perspective bottom view (FIG. 8B), respectively.
Figure 8B:
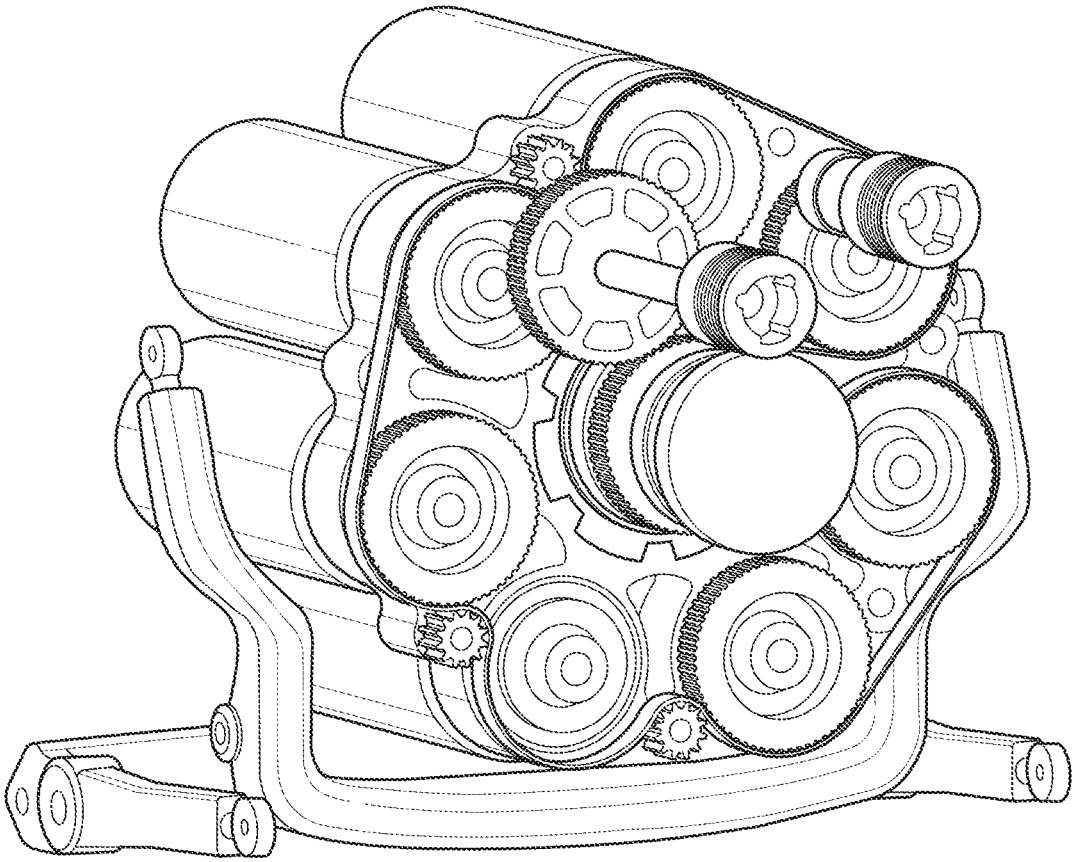

Rotary disc 5 with seven mandrels 2 and seven cylindrical objects 3 mounted thereon is shown in FIG. 7. FIG. 8A is a bottom view of rotary disc 5. Mandrel rotation coupling 5.9 and disc rotation coupling 5.10 are provided. Couplings 5.9, 5.10 are configured to be releasably connectable to a rotational force generator, analogously to rotation couplings 2.2, 2.2.1, 2.2.2 of the first and second embodiment.

Mandrel rotation coupling 5.9 is rigidly coupled to driving gear 5.11. Driving gear 5.11 meshes with a driven pulley 5.13 located at the center of the bottom of rotary disc 5. Driven pulley 5.13 drives belt 5.14 that is wound around seven mandrel gears 5.12. The rotation of driven pulley 5.13 that is driven by the rotational force generator through mandrel rotation coupling 5.9 and driving gear 5.11 is transmitted to seven mandrel gears 5.12 that are rigidly connected to the longitudinal axis of mandrels 2, respectively. Thus, a rotational force exerted by the rotational force generator is transmitted to seven mandrels 2, which are set into rotation around their longitudinal axis.

Disc rotation coupling 5.10 is coupled to a gear driving mechanism for rotary disc 5 and is configured to set rotary disc 5 into rotation around its center such that the positions of mandrels 2 in the circular arrangement on the rotary disc rotate.

With rotation drives for individual mandrels 2 and rotary disc 5, the lateral faces of all cylindrical objects 3 can be completely printed when rotary disc 2 is in its second position. Rotary disc 5 is rotated until one (e.g. the first) mandrel 2 is oriented such that the lateral surface of cylindrical object 3 mounted thereon is tangent to the reference plane. The lateral surface is printed while mandrel 2 is rotated around its longitudinal axis along with the other mandrels. Then, rotary disc 5 is rotated until the next (second) mandrel 2 is tangent to the reference plane. Again, all mandrels 2 are rotated around their longitudinal axis such that the lateral surface of the next (second) mandrel 2 is printed. That process is repeated until the lateral surfaces of all mandrels 2 are printed. It is also possible to rotate the mandrels around their longitudinal axis continuously, while rotary disc 5 is rotated to allow each mandrel 2 to come successively in contact with the reference plane.

Figure 9:
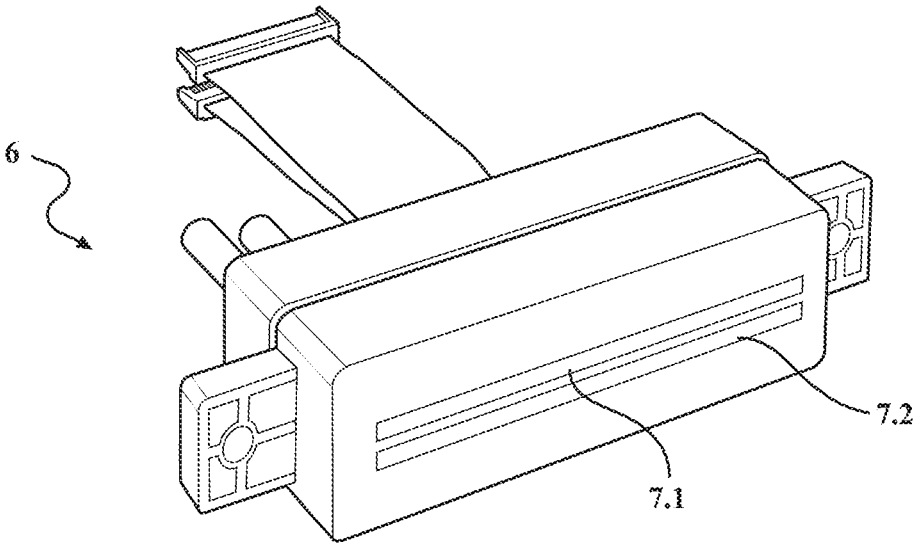
FIG. 9 is a schematic representation of a printhead to be used as a component of the printing system of the invention.

All three embodiments of the tiltable mounting device described above can be combined with printhead 6 to obtain a printing system for cylindrical objects. As printheads 6, industrial printheads may be used having closely spaced ink nozzles arranged in a row, to allow for printing at a high resolution. The printheads may also comprise multiple rows of nozzles that are arranged in parallel on the printhead. A schematic representation of printhead 6 with two rows 7.1, 7.2 of ink nozzles is shown in FIG. 9.

The basic arrangement of printhead 6 for a printing system according to the present invention is exemplarily shown in FIGS. 3 and 4. Preferably, printhead 6 is arranged relative to tiltable mounting device 10 such that the ink nozzles are arranged in parallel or along to the longitudinal axes of mandrels 2 in the second position and faces the portion of a cylindrical object when the corresponding mandrel is in the second position, as shown in FIGS. 3 and 4. By such an arrangement, the segment of the lateral surface of cylindrical object 3 that is tangent to the reference plane is accessible by the ink nozzles of printhead 6, such that printhead 6 may remain stationary while printing. When printhead 6 comprises multiple rows of ink nozzles, printhead 6 may additionally be movable parallel to the reference plane and perpendicular to the rows of ink nozzles, so that each row can be positioned over the section of the lateral surface of cylindrical object 3 that is tangent to the reference plane.

When printhead 6 is movable in such a manner, it is possible to move printhead 6 and maintain the position of mandrels 2 fixed when mandrels 2 are in the first position, in order to print the top surfaces of cylindrical objects 3. Alternatively, as described above, when mandrels 2 are in the first position, printhead 6 is left in a fixed position while mandrels 2 and/or rotary disc 5 are rotated in order to print the top surfaces of cylindrical objects 3.

If color printing is to be realized, it may be preferable to provide individual printheads for different colors. Even then, tiltable mounting devices described above are suitable to increase the throughput and efficiency of a printing process. Hereby, tiltable mounting device 10 is installed on a conveying device that is configured to successively move tiltable mounting device 10 to multiple printheads. At each printhead, the tiltable mounting device 10 is tilted to the first and second position whilst rotating mandrels 2 and/or rotary disc 5 in order to enable printing of the top and lateral surface of cylindrical objects 3 mounted on mandrels 2.

In each of the printing systems obtained by combining one or more printheads 6 with a tiltable mounting device 10 according to any of the embodiments above, the tiltable mounting device 10 may be configured such that it is movable in a direction parallel to the reference plane, preferably in a direction parallel to the reference plane and perpendicular to the direction along which the rows 7.1, 7.2 of ink nozzles are arranged. Thus, when the tiltable mounting device 10 is tilted into the first position, such that the top surfaces of the cylindrical objects 3 are to be printed, the tiltable mounting device 10 may be moved parallel to the reference plane so that the entire top surface of the cylindrical objects 3 may be moved into a position accessible by the printheads 6 without rotating the cylindrical objects. Alternatively, a combination of translational movement of the tiltable mounting device 10 and a rotation of the cylindrical objects may be employed to print the entire top surfaces.

Figure 10:
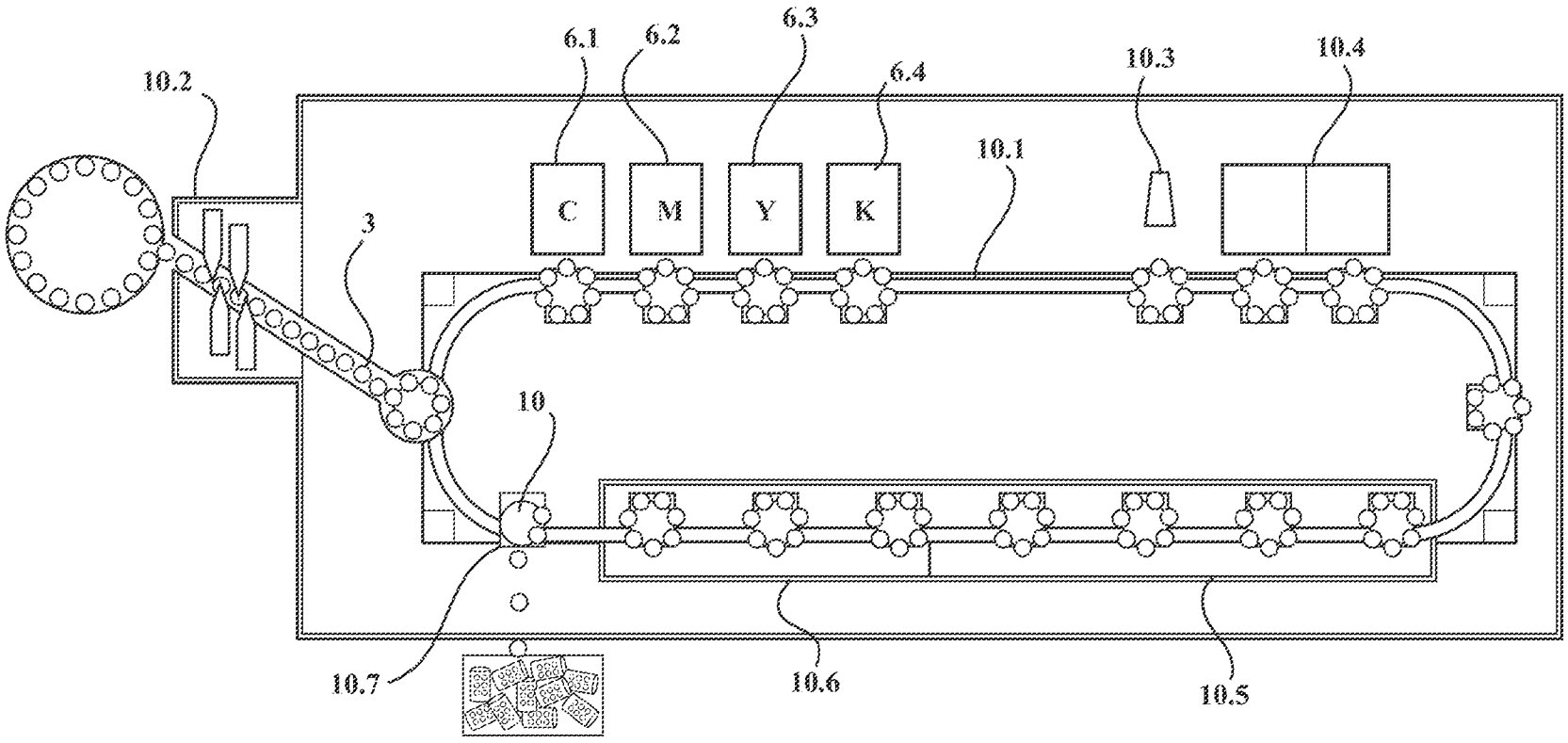
FIG. 10 is a schematic representation of a printing system with a plurality of tiltable mounting devices, a plurality of printheads and an endless conveyor belt according to the present invention.

FIG. 10 shows a schematic representation of a printing system with a plurality of printheads 6.1, 6.2, 6.3, 6.4. A plurality of tiltable mounting devices 10 (in FIG. 10, the tiltable mounting devices 10 are schematically depicted as circles) are established on a precision linear transport system, constituted in FIG. 10 by an endless conveyor belt 10.1. Cylindrical objects 3 to be printed are supplied from the left side of FIG. 10 and moved through a surface treatment area 10.2 for surface pre-treatment. Subsequently, cylindrical objects 3 are mounted on tiltable mounting devices 10. FIG. 10 shows tiltable mounting devices 10 with seven cylindrical objects 3, being mounted on each of them, as in the third embodiment. However, tiltable mounting devices according to the first and second embodiment may be employed as well.

Tiltable mounting device 10 with mounted cylindrical objects 3 is conveyed to first printhead 6.1. Here, the conveyor is halted. Tiltable mounting device 10 is subsequently tilted to the first and second position and mandrels 2 and/or rotary disc 5 are rotated appropriately to allow printing on the top and lateral surfaces of all mounted cylindrical objects 3 with first printhead 6.1. Then, tiltable mounting device 10 is conveyed to subsequent printheads 6.2, 6.3, 6.4 and halted there respectively for another printing step.

After all colors have been printed, tiltable mounting device 10 may be moved past inspection device 10.3 such as a camera, such that the printing quality can be assessed and double-checked for deficiencies. Subsequently, tiltable moving device 10 is conveyed to coating device 10.4 at which cylindrical objects 3 may be provided with a protective coating. Afterwards, cylindrical objects 3 on tiltable mounting device 10 are conveyed through drying area 10.5 and cool-down area 10.6. They are finally discharged from tiltable mounting device 10 at unloading area 10.7.

REFERENCE SIGN LIST

10 tiltable mounting device
1 frame
1.1 to 1.4 frame parts
1.5 alignment element
2 mandrel
2.0.1 first mandrel
2.0.2 second mandrel
2.1 mandrel mounting plate
2.1.1 first mandrel mounting plate
2.1.2 second mandrel mounting plate
2.2 rotation coupling
2.3 swing arm
2.3.1 first swing support
2.3.2 second swing support
3 cylindrical object
3.0.1 first cylindrical object
3.0.2 second cylindrical object
3.1 top surface
3.2 lateral surface
4.1 first bracket
4.2 second bracket
4.3 linkage plate
4.3.1, 4.3.2 connecting section

4.3.3 center hole
4.4 linkage plate
4.4.1 actuated extension
4.5 actuating rod
4.6.1, 4.6.2 connecting bars
4.8 spring
5 rotary disc
5.1 rotary disc mounting element
5.2 first joint arm
5.2.1 joint
5.3 second joint arm
5.3.1 joint
5.4 swing arm
5.4.1 joint
5.5 swing plate
5.5.1, 5.5.2, 5.5.3 joints
5.6 second swing plate
5.6.1, 5.6.2 joints
5.7 third joint arm
5.7.1 joint
5.8 extension
5.9 mandrel rotation coupling
5.10 disc rotation coupling
5.11 driving gear
5.12 mandrel gear
5.13 driven pulley
5.14 belt
6, 6.1 to 6.4 printheads
10.1 (endless) conveyor (belt)
10.2 surface treatment area
10.3 inspection device
10.4 coating device
10.5 drying area
10.6 cool-down area
10.7 unloading area

The invention claimed is:

1. A tiltable mounting device for mounting one or more screw caps and for tilting the one or more screw caps relative to a reference plane, the one or more screw caps each comprising a top surface, a lateral surface, and an inner surface bounding a cavity, the tiltable mounting device comprising:

a frame, one or more mandrels that are each configured to be inserted into the cavity of a screw cap for mounting the one or more screw caps while leaving the top surface of the one or more screw caps exposed, wherein each mandrel of the one or more mandrels has a longitudinal axis around which the mandrel is rotatable, wherein each mandrel is tiltable in the frame between a first position and a second position, wherein the longitudinal axis of each mandrel in the first position is oriented perpendicularly to the longitudinal axis of the mandrel in the second position, wherein, in the first position, each mandrel is oriented such that top surface of the screw cap mountable on the mandrel lies in the reference plane, and in the second position, each mandrel is oriented such that the lateral surface of the screw cap mountable on the mandrel is tangent to the reference plane.

2. The tiltable mounting device according to claim 1, wherein the one or more mandrels consists of a single mandrel.

3. The tiltable mounting device according to claim 1, wherein the one or more mandrels comprises two mandrels.

4. The tiltable mounting device according to claim 3, wherein the two mandrels comprise first and second mandrels mounted in the frame such that when the first mandrel is oriented in the first position, the second mandrel is oriented in the second position, and vice versa.

5. The tiltable mounting device according to claim 1, further comprising a rotation coupling for each mandrel of the one or more mandrels that is configured to be releasably coupled with a rotational force generator to rotate the mandrel around its longitudinal axis.

6. The tiltable mounting device according to claim 1, further comprising at least one actuating element that is slidably mounted on the frame and configured to cause a tilting of the one or more mandrels when the at least one actuating element is actuated.

7. The tiltable mounting device according to claim 6, wherein the at least actuating element is hingeably coupled to one or more linkage plates that are configured to translate a translational motion of the at least one actuating element into a tilting of the one or more mandrels.

8. A tiltable mounting device for mounting cylindrical objects, particularly screw caps, that comprise a top surface and a lateral surface, and for tilting the cylindrical objects relative to a reference plane, the tiltable mounting device comprising:

a frame, a rotary disc on which a plurality of mandrels are mounted in parallel in a circular arrangement, wherein each mandrel of the plurality of mandrels is configured to mount a cylindrical object, particularly a screw cap, wherein each mandrel of the plurality of mandrels has a longitudinal axis around which the mandrel is rotatable, wherein the rotary disc is tiltable in the frame between a first position and a second position, wherein, when the rotary disc is in the first position, the rotary disc is oriented such that the longitudinal axes of the mandrels of the plurality of mandrels are oriented perpendicularly to the longitudinal axes of the mandrels in the second position, wherein, when the rotary disc is in the first position, the mandrels are oriented such that top surfaces of the screw caps mountable on the mandrels lie in the reference plane, and wherein, when the rotary disc is in the second position, the mandrels are oriented such that, when rotating the rotary disc, lateral surfaces of the screw caps mountable on the mandrels are tangent to the reference plane.

9. The tiltable mounting device according to claim 8, wherein the plurality of mandrels comprises seven mandrels.

10. The tiltable mounting device according to claim 8, further comprising a mandrel rotation coupling that is configured to be releasably coupled with a rotational force generator to rotate each mandrel of the plurality of mandrels around the longitudinal axis of the mandrel.

11. The tiltable mounting device according to claim 8, further comprising a disc rotation coupling that is configured to be releasably coupled with a rotational force generator to rotate the rotary disc.

12. The tiltable mounting device according to claim 8, wherein the tiltable mounting device is connectable to an actuating element that is configured to cause a tilting of the rotary disc when the actuating element is actuated.

13. A printing system for cylindrical objects, comprising:

at least one tiltable mounting device according to claim 1, at least one printhead that is configured to print on top and lateral surfaces of the one or more screw caps.

14. A printing system for cylindrical objects, comprising:

at least one mounting device according to claim 8, at least one printhead that is configured to print on surfaces of screw caps in the reference plane.

15. The printing system according to claim 13, wherein the at least one printhead is configured as an industrial printhead with one or more rows of ink nozzles that are arranged in parallel on the at least one printhead.

16. The printing system according to claim 13, wherein the at least one printhead is configured to be movable in a direction parallel to the reference plane and perpendicular to the longitudinal axis of the one or more mandrels in the second position.

17. The printing system according to claim 13, wherein the at least one mounting device is configured to be movable in a direction parallel to the reference plane.

18. The printing system according to claim 13, further comprising a conveying device that is configured to move the at least one tiltable mounting device into a vicinity of the at least one printhead.

19. A method for printing on screw caps, the method comprising the following steps:

mounting at least one screw cap on at least one mandrel of at least one tiltable mounting device according to claim 1 while leaving the top surface of the at least one screw cap exposed, and providing at least one printhead that is configured to print on top and lateral surfaces of screw caps, tilting the at least one mandrel into the first position, printing on a top surface of at least one screw cap, tilting the at least one mandrel into the second position, rotating the at least one mandrel around the longitudinal axis and printing on the lateral surface of the at least one screw cap.

20. A method for printing on cylindrical objects, particularly screw caps, the method comprising the following steps:

mounting a plurality of screw caps on the plurality of mandrels of a tiltable mounting device according to claim 8, tilting the rotary disc into the first position, printing on top surfaces of the plurality of screw caps, tilting the rotary disc into the second position, rotating the rotary disc and each mandrel of the plurality of mandrels around longitudinal axis of the mandrel and printing on lateral surfaces of the plurality of screw caps.

21. The method according to claim 19, wherein the printing on the top surface of the at least one screw cap comprises rotating the at least one mandrel.

22. The method according to claim 20, wherein the printing on the top surfaces of the plurality of screw caps comprises rotating the rotary disc and/or the plurality of mandrels.

23. The method according to claim 19, wherein the printing on the top surface of the at least one screw cap comprises moving the tiltable mounting device parallel to the reference plane.

24. The method according to claim 19, wherein the printing on the top surface of the at least one screw cap and/or printing on the lateral surface of the at least one screw cap comprises moving the at least one printhead parallel to the reference plane.

25. The method according to claim 19, wherein the printing on the top surface of the at least one screw cap is performed with a first printhead of the at least one printhead, the tiltable mounting device is moved to at least one further printhead, and the printing on the lateral surface of the at least one screw cap is performed with the at least one further printhead of the at least one printhead.

26. The tiltable mounting device according to claim 1, wherein each of the one or more mandrels comprises an expansion region that is expandable in a radial direction relative to the longitudinal axis, wherein the expansion region is configured to provide a friction fit with the inner surface of a screw cap received on the mandrel.

27. The tiltable mounting device according to claim 8, wherein each mandrel of the plurality of mandrels comprises an expansion region that is expandable in a radial direction relative to the longitudinal axis, wherein the expansion region is configured to provide a friction fit with an inner surface of a screw cap received on the mandrel.

* * * * *